US006109738A

United States Patent [19]

Miyata et al.

[11] Patent Number: 6,109,738

[45] Date of Patent: Aug. 29, 2000

[54] INK JET PRINT HEAD AND A METHOD OF MANUFACTURING THE SAME

[75] Inventors: Yoshinao Miyata; Shinri Sakai, both of Nagano, Japan

[73] Assignee: Seiko Epson Corporation, Tokyo, Japan

[21] Appl. No.: 09/122,655

[22] Filed: Jul. 27, 1998

[30] Foreign Application Priority Data

Jul. 25, 1997 [JP] Japan ..... 9-200650
Jul. 25, 1997 [JP] Japan ..... 9-200651

[51] Int. Cl.[7] ..... B41J 2/045

[52] U.S. Cl. ..... 347/71; 310/328

[58] Field of Search ..... 347/68–71; 310/320

[56] References Cited

U.S. PATENT DOCUMENTS

| | | | |
|---|---|---|---|
| 4,752,788 | 6/1988 | Yasuhara et al. | 347/68 |
| 5,491,500 | 2/1996 | Inui et al. | 347/48 |
| 5,510,819 | 4/1996 | Fujimoto et al. | 347/70 |
| 5,530,465 | 6/1996 | Hasegawa et al. | 347/70 |
| 5,896,149 | 4/1999 | Kitahara et al. | 347/70 |
| 5,929,881 | 7/1999 | Kitahara et al. | 347/70 |

FOREIGN PATENT DOCUMENTS

| | | | |
|---|---|---|---|
| 0 755 793 | 1/1997 | European Pat. Off. . | |
| 0 786 345 | 7/1997 | European Pat. Off. . | |
| 0 841 165 | 5/1998 | European Pat. Off. . | |
| 5-286131 | 11/1993 | Japan | B41J 2/045 |

OTHER PUBLICATIONS

Patent Abstracts of Japan, vol. 007, No. 230 (M–249), Oct. 12, 1983.
Patent Abstracts of Japan, vol. 018, No. 098 (M–1562) Feb. 17, 1994.
Patent Abstracts of Japan, vol. 096, No. 001, Jan. 31, 1996.

*Primary Examiner*—John Barlow
*Assistant Examiner*—Craig A. Hallacher
*Attorney, Agent, or Firm*—Sughrue, Mion, Zinn, Macpeak & Seas, PLLC

[57] ABSTRACT

An ink jet print head includes a plural number of piezoelectric vibrators each consisting of a lower electrode film, a piezoelectric film and an upper electrode film. The piezoelectric film and the upper electrode film of each piezoelectric vibrator are formed within the region facing each pressure generating chamber. The lower electrode films interconnect portions of the regions facing the pressure generating chambers and are electrically continuous to a wiring pattern connected to an external circuit, and in each of the portions of the regions facing the pressure generating chambers, each portion not having the piezoelectric vibrator is removed except a part thereof. Such a structure secures a satisfactory function of the lower electrode layer as a common electrode, increases a quantity of displacement of the piezoelectric vibrator while keeping a low compliance, increases an ink discharging speed, and reduces a drive voltage.

41 Claims, 13 Drawing Sheets

INK JET PRINT HEAD AND A METHOD OF MANUFACTURING THE SAME

BACKGROUND OF THE INVENTION

1. Field of the Invention

The present invention relates to an ink jet print head of the type in which pressure generating chambers communicate with nozzle openings, each pressure generating chamber includes an elastic film and a piezoelectric element formed on the elastic film, and the piezoelectric element is displaced to eject ink droplets through the nozzle opening.

2. Discussion of the Prior Art

There is known an ink jet print head of the type in which pressure generating chambers communicate with nozzle openings, each pressure generating chamber includes an elastic film and a piezoelectric element formed on the elastic film, and the piezoelectric element is displaced to pressurize ink within the pressure generating chamber to cause the chamber to eject ink droplet or droplets through its associated nozzle opening. The ink jet print head, currently marketed, is classified into two types of ink jet print head: a first type of ink jet print head constructed by the utilization of a piezoelectric actuator which vibrates in a longitudinal direction, viz., it expands and contracts in the axial direction of the piezoelectric element, and a second type of ink jet print head by the utilization of a piezoelectric actuator in a flexural vibration aspect.

In the first type of ink jet print head, the volume of the pressure generating chamber is varied by bring the end face of the piezoelectric element into contact with the elastic film. This type of ink jet print head is suitable for a high density printing. However, its manufacturing process is complicated since the following manufacturing steps, technically difficult and additional, are required: to cut the piezoelectric element at the pitches of the array of nozzle openings so as to have a saw-tooth shape, and to position and fasten the thus cut piezoelectric element to the pressure generating chamber.

In the second type of ink jet print head, the piezoelectric element may be attached to the elastic film in a relatively simple manner: a green sheet of piezoelectric material is stuck onto the pressure generating chambers after the patterning of the pressure generating chambers, and the resultant structure is sintered. This type of ink jet print head utilizes a flexure vibration. Therefore, a relatively large area is required for producing the print head. This fact makes it difficult to form the print head of a density array.

To solve the above problems, another print head is proposed in Japanese Patent Laid-Open Publication No. Hei-5-286131. In the publication, a piezoelectric element is formed uniformly over the entire surface of an elastic film by film forming technique. The piezoelectric layer is separated after the patterning of pressure generating chambers by a lithography method. The piezoelectric elements are formed one for one pressure generating chamber.

The technique of the publication succeeds in eliminating the work to stick the piezoelectric elements onto the elastic films, and it allows the piezoelectric actuator to be stuck onto the pressure generating chamber by the precise and simple process, or the lithography method. Further, the technique has other advantages: only the piezoelectric actuators are thinned, and hence the resultant print head is operable at high speed. In this case, the piezoelectric actuators associated with the pressure generating chambers can be driven in a state that the piezoelectric layer is layered over the entire surface of the elastic film, and at least the upper electrodes are provided one for each pressure generating chamber. The piezoelectric active portions, each consisting of the piezoelectric layer and the upper electrode layer, are each preferably confined within the region on its associated pressure generating chamber, when considering a quantity of displacement of the piezoelectric actuator for unit drive voltage, a stress acting on the piezoelectric layer at a bridge between the region facing the pressure generating chamber and a region other than the former.

Generally, a piezoelectric constant of a piezoelectric thin film is ½ to ⅓ as large as of a piezoelectric thick film. Therefore, the use of the piezoelectric thin film fails to provide of the ejection of an effective amount of ink.

To increase the quantity of displacement of the piezoelectric actuator when it is driven, it is desirable to increase its compliance by thinning the lower electrode. In this case, however, another problem arises which reduces a pressurizing force to be additionally applied.

If the lower electrode is patterned leaving only its portion corresponding to the piezoelectric active portions, the quantity of vibrator displacement is increased retaining an optimum compliance. In this case, the wiring pattern serving also as lower electrodes cannot be secured. Attempt to realize both ends entails the increase of the number of patterning steps and cost to manufacture.

SUMMARY OF THE INVENTION

Accordingly, an object of the present invention is to provide an ink jet print head which secures a satisfactory function of the lower electrode layer as a common electrode, increases a quantity of displacement of the piezoelectric vibrator while keeping a low compliance, increases an ink discharging speed, and reduces a drive voltage.

Another object of the present invention is to provide a process for manufacturing the above ink jet print head.

Still another object of the present invention is to provide an ink jet print head which decreases the number of required patterning steps, increases a quantity of displacement of the piezoelectric vibrator, increases an ink discharging speed, and reduces a drive voltage.

Yet another object of the invention is to provide a process for manufacturing the above ink jet print head.

A first aspect of the present invention is an ink jet print head comprising a plurality of pressure generating chambers, elastic films and piezoelectric elements, the piezoelectric elements being formed in regions facing said pressure generating chambers, and each of said piezoelectric elements including a lower electrode film, a piezoelectric film and an upper electrode film, wherein A) said piezoelectric film, said upper electrode film and said lower electrode film are formed within said region facing each said pressure generating chamber; and B) portions of said lower electrode films facing said pressure generating chambers are continuous to a wiring pattern interconnecting said regions facing said pressure generating chambers, and in each of said regions facing said pressure generating chambers, a portion of said lower electrode film not facing said piezoelectric film is removed except a part thereof.

In the first aspect of the invention, a pattern of the piezoelectric film the upper electrode film, and the lower electrode film which form each piezoelectric vibrator, are formed within the region facing each pressure generating chamber. In each of the regions facing the edges of the pressure generating chambers, a portion of the lower electrode film is removed except a part thereof.

A second aspect of the invention is the ink jet print head of the first aspect in which in each of the regions facing the pressure generating chambers, a portion of the lower electrode film not having the piezoelectric film of each piezoelectric vibrator is removed except at least one end thereof.

In the structure of the second aspect, its stress caused when the piezoelectric vibrator is driven, is reduced to thereby prevent its end (when longitudinally viewed) from being damaged.

A third aspect of the invention is an ink jet print head comprising a plurality of pressure generating chambers, elastic films and piezoelectric elements, the piezoelectric elements being formed in regions facing said pressure generating chambers, and each of said piezoelectric elements including a lower electrode film, a piezoelectric film and an upper electrode film, wherein A) said piezoelectric film, said upper electrode film and said lower electrode film are formed within said region facing each said pressure generating chamber, while a pair of narrow arm portions thereof extend outward beyond each of said regions facing said pressure generating chambers; and

B)

a) portions of said lower electrode films where in said regions facing said pressure generating chambers are continuous to a wiring pattern interconnecting said regions facing said pressure generating chambers and being connected to exterior, b) in each of said regions facing said pressure generating chambers, a portion of said lower electrode film not facing said piezoelectric film is removed except a part thereof located between said paired narrow arm portions, and c) in said lower electrode films wherein said region facing said pressure generating chamber is continuous to said wiring pattern between each said pair of narrow arm portions.

In the third aspect, a pattern of a piezoelectric vibrator facing a pressure generating chamber is not extended outward to beyond the region facing the pressure generating chamber, except at least a pair of narrow arm portions. The lower electrode layer is substantially removed in the region facing the edge of the pressure generating chamber. Therefore, it has a large displacement when driven. Since the narrow arm portions of the piezoelectric vibrator in which a stress is produced when the vibrator is driven is narrow, those are little cracked. If it is cracked, the cracking will not reach its main body.

A fourth aspect of the invention is the ink jet print head of the third aspect in which a narrow strip layer consisting of the piezoelectric layer and the upper electrode film is formed along an outer edge of a region facing a portion of the peripheral edge of the pressure generating chamber where the lower electrode film is removed, the outer edge being opposite to that closer to the pressure generating chamber, while being not continuous to the narrow arm portions.

In patterning the lower electrode removal portions in the vicinity of the peripheral edge of the pressure generating chamber, the piezoelectric layers and upper electrode layers of the piezoelectric vibrators, the narrow strip layer located outside the lower electrode removal portion is disconnected from the piezoelectric vibrators within the pressure generating chambers, thereby providing an efficient use of the drive voltage. This occurs when the patterning of them is performed about two times while protecting the silicon dioxide film.

A fifth aspect of the invention is an ink jet print head comprising a plurality of pressure generating chambers, elastic films and piezoelectric elements, the piezoelectric elements being formed in regions facing said pressure generating chambers, and each of said piezoelectric elements including a lower electrode film, a piezoelectric film and an upper electrode film, wherein A) said piezoelectric film, said upper electrode film and said lower electrode film are formed within said region facing each said pressure generating chamber, while a pair of narrow arm portions thereof extend outward beyond each of said regions facing said pressure generating chambers;

B)

a) portions of said lower electrode films where in said regions facing said pressure generating chambers are continuous to a wiring pattern interconnecting said regions facing said pressure generating chambers and being connected to exterior, b) in each of said regions facing said pressure generating chambers, a portion of said lower electrode film not facing said piezoelectric film is removed except a part thereof located between said paired narrow arm portions, and c) said region facing said pressure generating chamber is continuous to said wiring pattern between each said pair of narrow arm portions; and C) a narrow strip layer consisting of said piezoelectric layer and said upper electrode film is formed along the outer edge of said wiring pattern of said lower electrode film.

In the fifth aspect of the invention, a pattern of a piezoelectric vibrator facing a pressure generating chamber is not extended outward to beyond the region facing the pressure generating chamber, except at least a pair of narrow arm portions. The lower electrode layer is substantially removed in the region facing the edge of the pressure generating chamber. Therefore, it has a large displacement when driven. Since the narrow arm portions of the piezoelectric vibrator in which a stress is produced when the vibrator is driven is narrow, those are little cracked. If it is cracked, the cracking will not reach its main body. To remove the unnecessary piezoelectric layers and the upper electrode layers from the whole pattern of the lower electrode layer, the patterning of them is performed two times while protecting the silicon dioxide film. At this time, a narrow strip layer is formed.

A sixth aspect of the invention is the ink jet print head of any of the third to fifth aspects in which each pair of narrow arm portions of the piezoelectric layers and the upper electrode layers, extend from at least one end, when longitudinally viewed, of each piezoelectric vibrator to both sides thereof in the widthwise direction orthogonal to the lengthwise direction thereof to beyond the region facing the pressure generating chamber.

A pair of narrow arm portions are located at one end (when longitudinally viewed) of each piezoelectric vibrator, and the lower electrode layers are connected to its whole pattern between the paired narrow arm portions. The structure increases a quantity of displacement of the piezoelectric layer, and minimizes unwanted matters resulting from a stress caused when the piezoelectric vibrator is driven.

A seventh aspect of the invention is the ink jet print head of any of the third to fifth aspects in which each pair of narrow arm portions each consisting of the piezoelectric layers and the upper electrode layers is located on one of the sides of each piezoelectric vibrator when viewed in the widthwise direction orthogonal to the lengthwise direction of the piezoelectric vibrator, while extending outward to the region facing the pressure generating chamber.

In the seventh aspect of the invention, a pair of narrow arm portions is located on one of the sides of each piezoelectric vibrator when viewed in the widthwise direction, and the lower electrode layers are connected to its whole pattern between the paired narrow arm portions. The structure increases a quantity of displacement of the piezoelectric layer, and minimizes unwanted matters resulting from a stress caused when the piezoelectric vibrator is driven.

An eighth aspect of the invention is the ink jet print head according to any of the third to fifth aspects in which each pair of narrow arm portions of the piezoelectric layers and the upper electrode layers is located on both sides of the corner of each piezoelectric vibrator, while extending in the directions orthogonal to each other to beyond the region facing the pressure generating chamber.

In the structure of the eighth aspect, each pair of narrow arm portions is located on both sides of the corner of each piezoelectric vibrator, and the lower electrode layers are connected to its whole pattern between the paired narrow arm portions. The structure increases a quantity of displacement of the piezoelectric layer, and minimizes unwanted matters resulting from a stress caused when the piezoelectric vibrator is driven.

A ninth aspect of the invention is the ink jet print head according to any of the first to eighth aspect in which the pressure generating chambers are formed in a silicon monocrystalline substrate by anisotropic etching, and the respective layers of the piezoelectric vibrators are formed by thin-film technique and lithography technique.

The structure of the ninth aspect enables a mass production of ink jet print heads having nozzle openings densely arrayed.

A tenth aspect of the invention is the ink jet print head according to any of the first to ninth aspects in which an insulating layer is formed on the top surface of the lower electrode films, and the insulating layer has contact holes as a window for forming the contact portions of lead electrodes and the upper electrode films.

With this structure, the piezoelectric vibrators are connected to the lead electrodes through contact holes.

An eleventh aspect of the invention is a process for producing an ink jet print head comprising:

a first step of successively forming a silicon dioxide film, a lower electrode film, a piezoelectric film and an upper electrode film, in this order, on a silicon substrate;

a second step of simultaneously patterning the lower electrode film, the piezoelectric film and the upper electrode film, to thereby form the whole wiring pattern of the lower electrode film;

a third step of patterning the piezoelectric film and the upper electrode film to form piezoelectric elements within the regions facing the pressure generating chambers; and a fourth step of patterning the lower electrode films to remove portions (third portions) of the lower electrode films except portions (second portions) thereof, which are continuous to the wiring pattern located out of the regions facing the pressure generating chambers, the second portions belonging to portions (first portions) not having the piezoelectric films forming the piezoelectric elements formed thereon in the regions facing the pressure generating chambers.

In the eleventh aspect, the whole pattern of the lower electrode layer formed on a silicon dioxide film, piezoelectric vibrators within the regions facing the pressure generating chambers, and the removal portions each having its portion continuous to the whole pattern of the lower electrode layers, which are located around each piezoelectric vibrator are formed. Therefore, less stress is produced in the piezoelectric vibrator when it is driven, so that a quantity of displacement of the piezoelectric layer is greatly improved.

A twelfth aspect of the invention is the print head producing process according to the eleventh aspect in which the lower electrode films removed in the fourth step are each located on both sides of each pressure generating chamber.

The lower electrode layer at the portions corresponding to the arms of both sides of the piezoelectric layer of each piezoelectric vibrator is removed to increase its compliance and displacement quantity.

A thirteenth aspect of the invention is a process for producing an ink jet print head comprising:

a first step in which a first layer is formed on a substrate and then a second layer and the subsequent layers are formed on the substrate in a successive manner;

a second step in which the plural number of layers formed on the first layer are simultaneously patterned to form the whole pattern of the second layers on the first layer and removal portions where the second and subsequent layers are removed within the whole pattern of the second layers are formed; and a third step in which by use of a resist pattern covering the removal portions and portions surrounded by the removal portions, the third layer and the subsequent ones are removed so that only the second layer is continuous and the third layer and the subsequent ones are not continuous at one location on the boundary between each of the portions surrounded by the removal portions and the remaining portion, and the patterns of the third and the subsequent layers surrounded by the removal portions are substantially surrounded by the second-layer continuous portions and the removal portions.

In the thirteenth aspect of the invention, the whole pattern of the second layer formed over the first layer, the removal portions of the second layer formed within the whole pattern, and a plurality of patterns each consisting of a plural number of layers including the second layer, formed in a region, except one location thereof, which is entirely surrounded by each removal portion, are provided. A pattern in which only the second layer in the region, except one location thereof, which is surrounded by each removal portion is continuous to the whole pattern of the second layer, is provided. Those patterns are formed in two steps by use of two kinds of resist patterns. By using the removal portions and the portion substantially surrounded by each removal portion for those resist patterns, the silicon dioxide films in the removal portions may be protected, and the portion of the third and subsequent layers surrounded by each removal portion is substantially isolated from the remaining portion.

A fourteenth aspect of the invention is a process for producing an ink jet print head comprising:

a first step for successively forming an elastic film, a lower electrode layer, a piezoelectric layer and an upper electrode layer on a passage forming substrate;

a second step in which the lower electrode layer, the piezoelectric layer and the upper electrode layer are simultaneously patterned to form the whole pattern of the lower electrode layers and removal portions where the lower electrode layer and subsequent layer layers are removed within the whole pattern of the second layers; and a third step in which by use of a resist pattern covering the removal portions and portions surrounded by the removal portions, the piezoelectric layer and the upper electrode layer are removed so that only the lower electrode layer is continuous and the piezoelectric layer and the upper electrode layer are not continuous at one location on the boundary between each of the portions surrounded by the removal portions and the remaining portion, and the piezoelectric layers surrounded by the removal portions and the patterns of the upper electrode layers are substantially surrounded by the lower-electrode continuous portions and the removal portions.

In the fourteenth aspect, the whole pattern of the lower electrode layers formed on the elastic film, the removal portions of the lower electrode layer formed within the whole pattern, and a plurality of patterns each consisting of the lower electrode layer, piezoelectric layer and upper electrode layer, formed in a region, except one location thereof, which is entirely surrounded by each removal portion, are provided. A pattern in which only the second layer in the region, except one location thereof, which is surrounded by each removal portion is continuous to the whole pattern of the second layer, is provided. Those patterns are formed in two steps by use of two kinds of resist patterns.

A fifteenth aspect of the invention is the print head producing process according to the fourteenth aspect in which the elastic film exposed at the removal portion is protected by the resist pattern which substantially covers the portions that are substantially surrounded by the removal portions in the second step and the remaining portion.

In this aspect of the invention, the exposed elastic films may be protected in the second step of the producing process.

A sixteenth aspect of the invention is the print head producing process according to the fourteenth or fifteenth aspect in which a resist pattern forming the patterns of the portions substantially surrounded by the removal portions in the second step covers the ends opposite to the portions substantially surrounded by the removal portions, the removal portions and the substantially surrounded portions of the removal portions cover, and does not cover a part of each removal portion for isolating the piezoelectric layer and the upper electrode layer from the opposite ends and the substantially surrounded portions.

The lower electrode layer, piezoelectric layer and upper electrode layer are patterned within the region facing each pressure generating chamber. Such a pattern that the piezoelectric layer and the upper electrode layer do not extend to the remaining portion, and only the lower electrode layer is continuous at least one location to the remaining portion and to the wiring pattern, is formed. Those patterns are formed in two steps.

A seventeenth aspect of the invention is the print head producing process according to any of the fourteen to sixteenth aspects in which the portions substantially surrounded by the removal portions are the regions facing the pressure generating chambers, the lower electrode layer, the piezoelectric layer and the upper electrode layer are patterned to have the layered structures of the layers each in each of the regions facing the pressure generating chambers, the piezoelectric layer and the upper electrode layer of each layered structure are not extended to the remaining portion, and only the lower electrode layer is continuous at least one location to the remaining portion to be connected to the wiring pattern.

In the structure of this aspect, a narrow strip portion consisting of the piezoelectric layer and the upper electrode layer is formed at its end opposite to the portion substantially surrounded by the removal portion, and the elastic film and the upper electrode layer in this portion are isolated from those of the portion substantially surrounded by the removal portion, and protection of the elastic film is ensured.

DETAILED DESCRIPTION OF THE PREFERRED EMBODIMENTS

The present invention will be described in detail with reference to the accompanying drawings.

<Embodiment 1>

Figure 1:
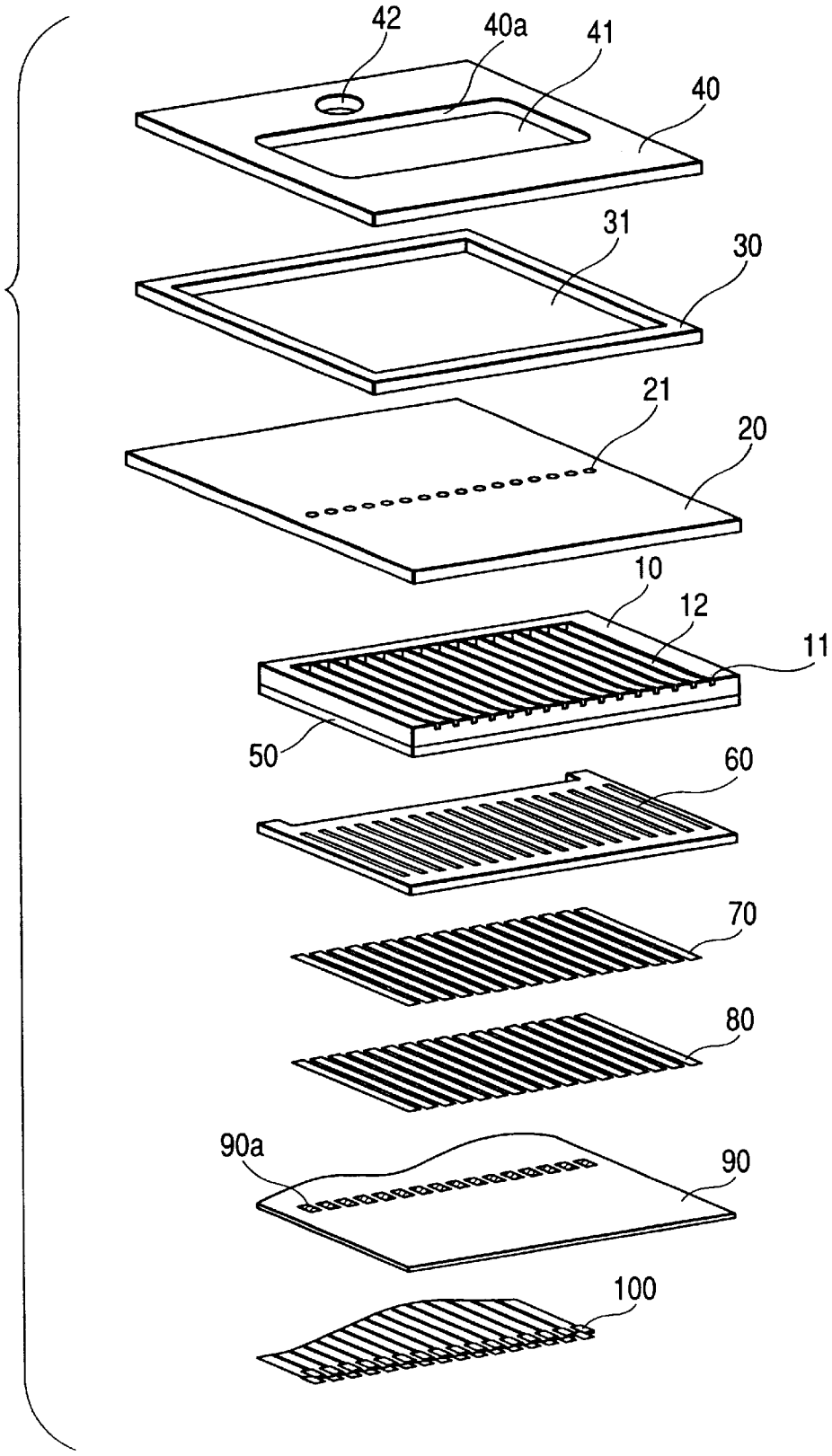
FIG. 1 is an exploded, perspective view showing an ink jet print head which is an embodiment 1 of the present invention.
Figure 2A:
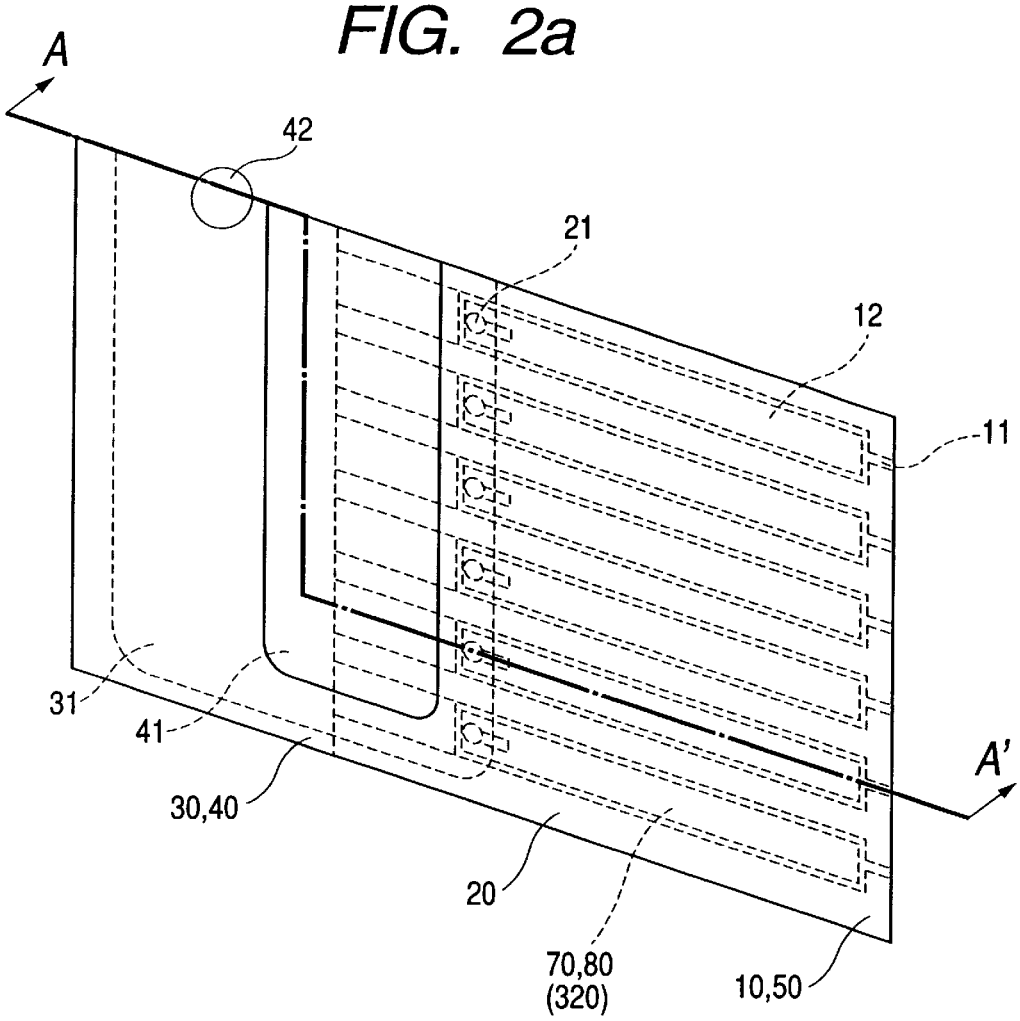
FIG. 2*a* is a plan view showing the ink jet print head of FIG. 1.
Figure 2B:
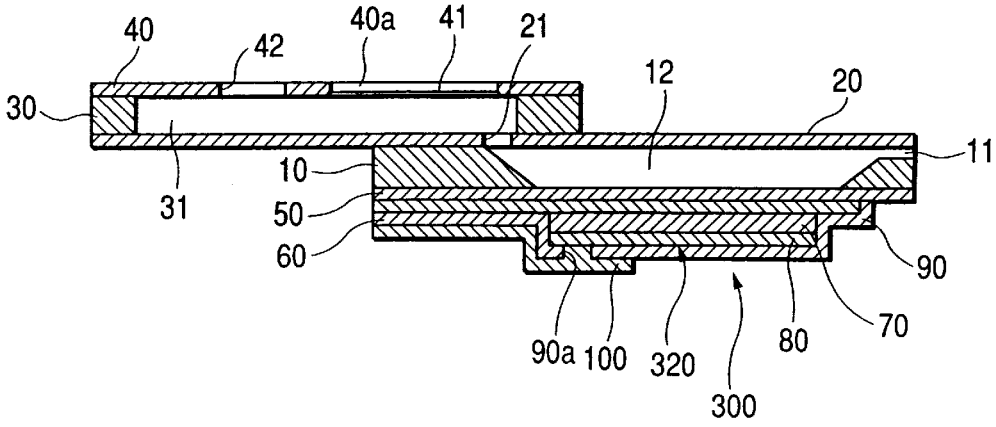
FIG. 2*b* is a cross sectional view taken on line A-A' in FIG. 2*a;*

FIG. 1 is an exploded, perspective view showing an ink jet print head which is an embodiment 1 of the present invention. FIG. 2*a* is a plan view showing the ink jet print head of FIG. 1. FIG. 2*b* is a cross sectional view taken on line A-A' in FIG. 2*a*.

In the figures, the passage forming substrate 10 is a silicon monocrystalline substrate with a lattice face (110). The passage forming substrate 10 is usually 150 to 300 μm thick, preferably 180 to 280 μm, and more preferably 220 μm. If so selected, the pressure generating chambers may be arrayed at high density while securing a satisfactory rigidity of each partitioning wall between the adjacent pressure generating chambers.

One of the major surfaces of the passage forming substrate 10 is opened, while the other has the elastic film 50. The elastic film 50 of dioxide silicon is formed, 1 to 2 μm thick, on the surface by thermal oxide process.

The nozzle openings 11 and the pressure generating chambers 12 are formed in the opened surface of the passage forming substrate 10 by anisotropically etching the silicon monocrystalline substrate.

For the anisotropic etching, the silicon monocrystalline substrate is immersed into an alkaline solution containing KOH. In the solution, the etching of the silicon monocrystalline substrate gradually progresses, so that first and second (111) faces appear. The first (111) face is normal to the (110) face of the silicon monocrystalline substrate, and a second (111) face appears, and the second (111) face is slanted at an angle of about 70° with respect to the first (111) face and at angle of about 35° with respect to the (110) face. The anisotropic etching utilizes such a nature that an etching rate on the (111) face is approximately 1/80 as high as an etching rate on the (110) face. The pressure generating chambers 12 may be arrayed precisely and at high density by etching the substrate according to a parallelogram defined by two first (111) faces and two second (111) faces.

In the present embodiment, the longer sides of each pressure generating chamber 12 are defined by the first (111) faces, while the shorter sides thereof are defined by the second (111) faces. Each of the pressure generating chambers 12 extends substantially equal to the thickness of the passage forming substrate 10, and reaches the elastic film 50. The elastic film 50 is a little immersed into the alkaline solution used for etching the silicon monocrystalline substrate.

Each nozzle opening 11 is communicatively coupled with one end of the related pressure generating chamber 12, and is narrower and shallower than the pressure generating chamber 12. In other words, the pressure generating chambers 12 are formed by etching the silicon monocrystalline substrate to the extent by half (half-etching). For the half-etching, the etching time is controlled.

The pressure generating chambers 12 and the nozzle openings 11 are optimumly dimensioned in consideration of an amount of ejected ink droplet, a discharging speed and a discharging frequency. Incidentally, the pressure generating chamber 12 applies a discharging pressure to the ink therein, and the nozzle opening 11 ejects an ink dropletlet or droplet therethrough. In an example where 360 ink droplets are ejected per inch square, it is necessary to precisely form the nozzle openings 11 to several tens μm in groove width.

The pressure generating chambers 12 communicate with the common ink chamber 31 (to be discussed later) through the ink supplying ports 21, which are formed in the sealing plate 20 at the positions corresponding to the ends of the pressure generating chambers 12. Ink is supplied from the common ink chamber 31 through the ink supplying ports 21 to the pressure generating chambers 12.

Figure 3A:
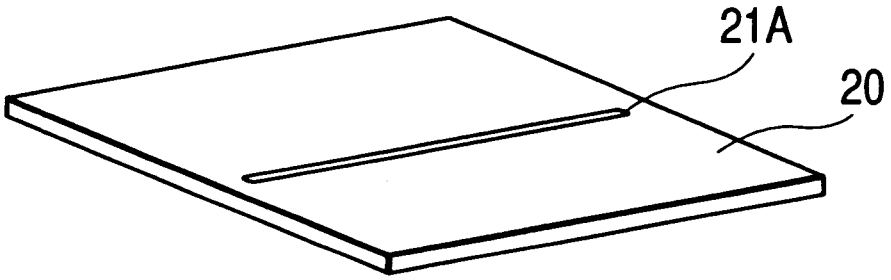
FIGS. 3*a* and 3*b* are perspective view showing modifications of a sealing plate used in the ink jet print head of FIG. 1.
Figure 3B:
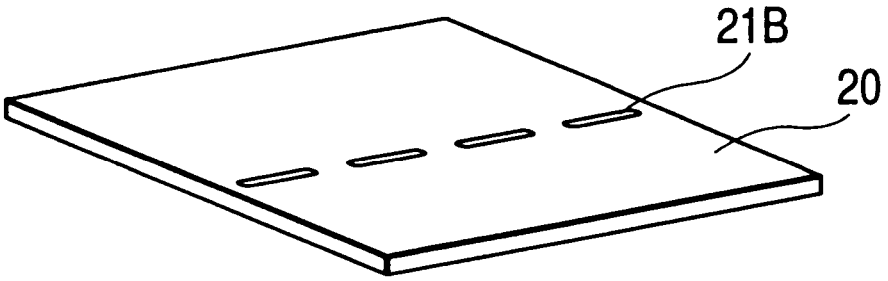
Figure 4A:
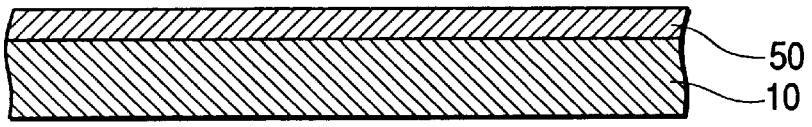
FIGS. 4(*a*)–(*d*) are diagrams showing a thin film producing process in the embodiment 1.
Figure 4B:
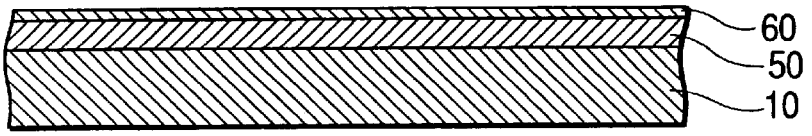
Figure 4C:
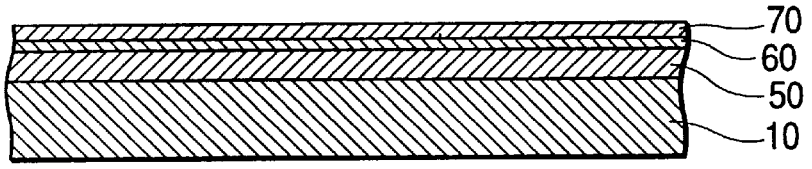
Figure 4D:
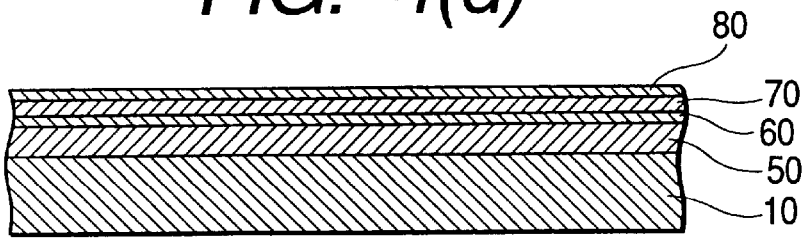
Figure 5A:
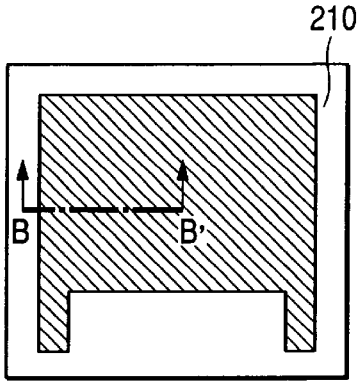
FIGS. 5(*a*)–(*f*) are diagrams showing another thin film producing process in the embodiment 1.
Figure 5B:
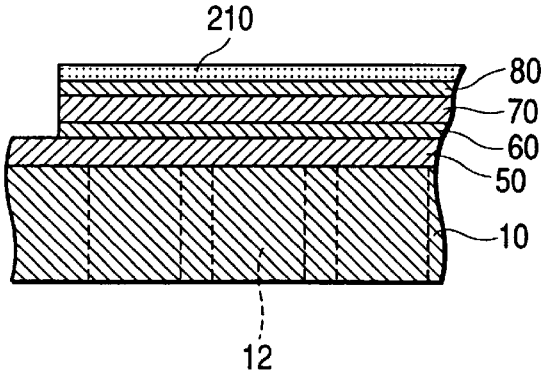
Figure 5C:
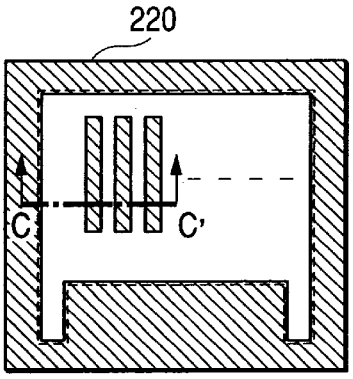
Figure 5D:
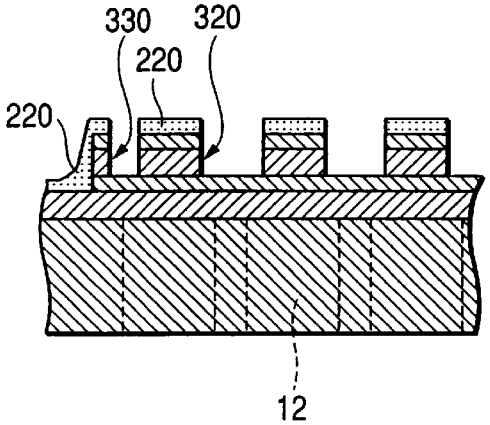
Figure 5E:
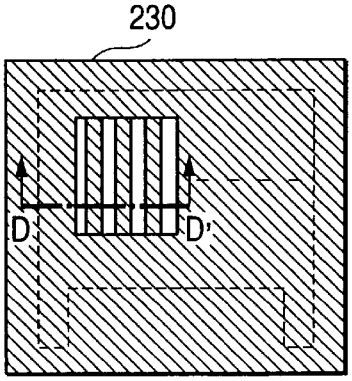
Figure 5F:
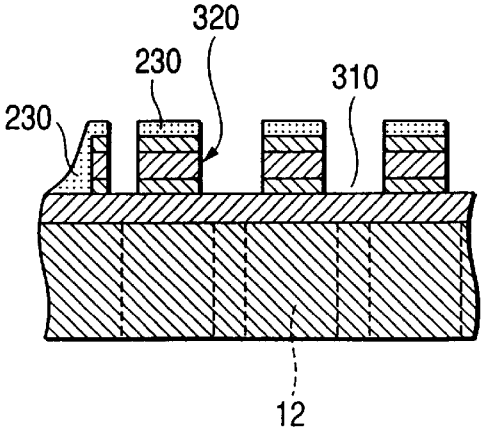

The sealing plate 20 has the ink supplying ports 21 formed therein arrayed while being positioned in connection with the pressure generating chambers 12. In this instance, the sealing plate 20 is physically and dimensionally specified: thickness—0.1 to 1 mm; expansion coefficient—2.5 to 4.5 [$\times 10^{-6}$/° C.] under the condition of 300° C. or lower; material—glass ceramics. The ink supplying ports 21 may be replaced with any other suitable ink supplying means. Two examples of the ink supplying means are illustrated in FIGS. 3*a* and 3*b*. The FIG. 3*a* example is a continuous long slit 21A which extends across the sealing plate 20 at a location near the ink-supplying-side ends of the pressure generating chambers 12. The FIG. 3*b* example is a linear array of a plural number of slits 21B which extends across the sealing plate 20 at a location near the ink-supplying-side ends of the pressure generating chambers 12. The sealing plate 20, which has the ink supplying means and covers entirely one major surface of the passage forming substrate 10, serves also as a reinforcing and protecting plate for protecting the silicon monocrystalline substrate, or the passage forming substrate 10, from accidental or unwanted external force applied thereto, e.g., impact. The other side of the sealing plate 20 forms one of the partitioning walls of the common ink chamber 31.

The common-ink-chamber forming substrate 30 defines the common ink chamber 31, and is formed by punching a stainless plate of which the thickness is selected in consideration of the number of nozzle openings and an ink discharging frequency. In the embodiment under discussion, the common-ink-chamber forming substrate 30 has a thickness of 0.2 mm.

The ink-chamber side plate 40, made of stainless, constitutes another partitioning wall of the common ink chamber 31. A part of the ink-chamber side plate 40 is half-etched to have the depressed recessed portion 40*a*. The bottom of the depressed recessed portion 40*a* serves as the thin wall 41. The ink-chamber side plate 40 further includes the ink inlet 42 through which ink is guided from an external ink source into the common ink chamber 31. The ink inlet 42 of the ink-chamber side plate 40 is formed by punching. The thin wall 41 absorbs a pressure which is generated when the ink droplet is shot forth and moves in the direction opposite to the nozzle openings 11, whereby it prevents an unnecessary positive or negative pressure from being applied to other pressure generating chambers 12 via the common ink chamber 31. The ink-chamber side plate 40 is designed in thickness such that its thin wall 41 is 0.02 mm thick and its remaining portion is 0.2 mm thick, while securing a rigidity necessary for the interconnection of its ink inlet 42 to an external ink source. If necessary, the ink-chamber side plate 40 may be 0.02 mm thick uniformly over its entire area. In this case, there is eliminated for the half-etching process for forming the thin wall 41.

The lower electrode film 60 of about 0.5 μm thick, the piezoelectric film 70 of about 1 μm thick, and the upper electrode film 80 of about 0.1 μm thick are successively layered in this order on the elastic film 50 by a process to be described later. The elastic film 50 is formed on the surface of the passage forming substrate 10, which is opposite to the opened surface. The layered structure constituted by lower electrode film 60, piezoelectric film 70 and upper electrode film 80 serves as a piezoelectric elements 300. The piezoelectric elements 300 is, usually, formed such that either of the upper and lower electrodes is used as a common electrode, and the other electrode and the piezoelectric film 70 are individually patterned for each pressure generating chamber 12. Of the piezoelectric element 300, a portion which includes a combination of the patterned electrode and piezoelectric film 70 and when receiving a voltage, is mechanically deformed will be referred to as a piezoelectric active portion 320. In the piezoelectric element 300 of the present embodiment, the lower electrode film 60 is a common electrode, and the upper electrode film 80 is an individual electrode. The reverse use of those electrodes is possible if it is required by the drive circuit and wiring. In either case, the piezoelectric active portion is formed every pressure generating chamber.

In the present embodiment, as will be described in detail later, the piezoelectric film 70 and the upper electrode film 80 are formed every pressure generating chamber 12, and the portions of the lower electrode film 60 to be the arms of each piezoelectric vibrator, which are located on both sides of each pressure generating chamber 12 (when viewed in its widthwise direction), are cut out, to thereby increase a quantity of its displacement. The portions of the lower electrode film 60 where it is connected to the pressure generating chambers 12 are connected to the whole pattern of the lower electrode film 60 at both ends of each pressure generating chamber 12 (when viewed in its lengthwise direction).

A process to form the piezoelectric film 70 and the like on the passage forming substrate 10 as the silicon monocrystalline substrate will be described with reference to FIGS. 4 and 5.

A wafer of a silicon monocrystalline substrate, which is to be a passage forming substrate 10, is placed in a diffusion furnace, and thermally oxidized at about 1100° C. to form an elastic film 50 of silicon dioxide (FIG. 4(*a*)). A lower electrode film 60 is formed by a sputtering method (FIG. 4(*b*)). Pt or the like is suitable for the material of the lower electrode film 60. The reason for this follows. A piezoelectric film 70 formed by a sputtering or sol-gel method (to be described later), after formed, must be sintered at about 600 to 1000° C. in an atmosphere of air or oxygen to thereby be crystallized. More exactly, it is necessary for a material of the lower electrode film 60 to retain a conductivity in such a high temperature and oxidizing atmosphere. Particularly where PZT is used for the material of the piezoelectric film 70, a material having a little variation of its conductivity caused by a diffusion of PbO is desirable for the material of the lower electrode film 60. It is for this reason that Pt is used for the lower electrode film 60.

A piezoelectric film 70 is formed on the lower electrode film 60 thus formed (FIG. 4(*c*)). A sputtering method may be used for forming the piezoelectric film 70, but in this embodiment a sol-gel method is used for its formation. In this method, a metal organic matter is dissolved into a solvent to form a called sol; the sol is gelled by coating and drying the sol; and the resultant gel is sintered at high temperature, whereby a piezoelectric film 70 of a metal oxide is formed. The piezoelectric film 70 is preferably made of a PZT (lead zirconate titanate) material when it is used for the ink jet print head.

An upper electrode film 80 is formed on the thus formed piezoelectric film 70 (FIG. 4(*d*)). The upper electrode film 80 may be made of any material if it is conductive. Examples of this kind of material are such metals as Al, Au, Ni and Pt, and conductive oxide. In this embodiment, Pt is sputtered to form the upper electrode film 80.

The thus multilayered films, lower electrode film 60, piezoelectric film 70 and upper electrode film 80, are patterned as shown in FIG. 5.

After a resist pattern 210 as shown in FIG. 5(*a*) is formed, the lower electrode film 60, piezoelectric film 70 and upper electrode film 80 are etched together to pattern the whole pattern of the lower electrode film 60 as shown in FIG. 5(*b*).

The resist pattern 210 may be formed in a manner that the structure is coated with negative resist HR-100 (trade mark of Fuji Hant), for example, spin coating and the resultant is subjected to exposure, development, baking by use of a mask of a predetermined pattern. Positive resist may be used in place of the negative resist, as a matter of course.

The etching operation is continued till the elastic film 50 is exposed. A dry etching apparatus, e.g., an ion milling apparatus, may be used for the etching operation. The resist pattern 210 is removed by use of an ashing apparatus, for example.

Reaction etching process may be used in place of the ion milling process for the dry etching process. Wet etching process may be used in place of the dry etching process. However, the use of the dry etching process is suggestible because the wet etching process is inferior, in patterning accuracy, to the dry etching process, and in the wet etching process, the materials available for the upper electrode film 80 are limited in number.

Only the layered structure consisting of the piezoelectric film 70 and the upper electrode film 80 is selectively etched away by use of a resist pattern 220 as an etching mask, which covers regions where the elastic film 50 is exposed and regions facing the pressure generating chambers 12, both the regions being contained in the other portion than the whole pattern of the lower electrode film (FIG. 5(*c*)), whereby piezoelectric active portions 320 are patterned (FIG. 5(*d*)). Through the patterning operation, the films 70 and 80 are isolated from the films in the regions than those facing the pressure generating chambers 12. The formation of the resist pattern 220 and the etching operation may be performed in the same manner as previously described.

Figure 6:
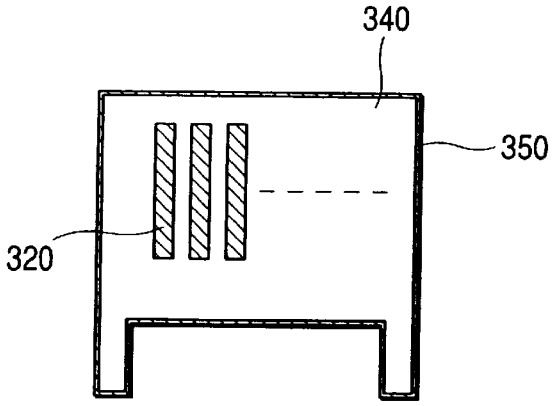
FIG. 6 is a plan view showing a key portion of the embodiment 1.

The piezoelectric film 70 and the upper electrode film 80, which do not contribute to form the piezoelectric active portions, are substantially removed in the embodiment under discussion. However, in the instant embodiment, the elastic film 50 of silicon dioxide is exposed in the other portions than the whole pattern of the lower electrode film 60. For protecting those portions against the etching liquid, the resist pattern 220 is extended to cover the peripheral edge of the whole pattern of the lower electrode film 60. For this reason, a narrow fringe portion 350 consisting of the piezoelectric film 70 and the upper electrode film 80 is present around the whole lower-electrode pattern 340, as shown in FIG. 6.

The lower electrode film 60 is patterned as shown in FIG. 5(*f*) by use of a resist pattern 230 as a mask which, as shown in FIG. 5(*e*), covers other areas than the regions corresponding to the arms of each piezoelectric vibrator, which are on both sides of each of the piezoelectric active portions 320 in the regions facing to both sides (when laterally viewed) of each pressure generating chamber 12 (indicated by dotted lines although those changers are not yet formed in the illustration of FIG. 5). The result is the formation of the lower-electrode removal portions 310. It is noted that with provision of the lower-electrode removal portions 310, when voltage is applied across the piezoelectric active portion 320, a quantity of its flexural displacement is increased.

As described above, to carry out the patterning process is carried out, the whole pattern 340 of the lower electrode film 60 is first patterned; the piezoelectric active portions 320 are patterned; and finally the lower-electrode removal portions 310 are patterned.

Figure 7A:
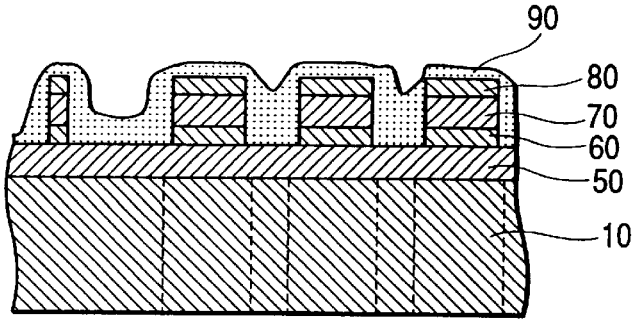
FIGS. 7(*a*)–(*c*) are diagrams showing a process of forming an insulation layer and a pressure generating chamber in the embodiment 1.

Following the patterning process, the insulation layer 90 having an electrical insulating nature is preferably formed covering at least the peripheral fringe of the top of the upper electrode film 80, the side faces of the piezoelectric film 70, and the side faces of the lower electrode film 60 (FIG. 7a). Such a preferable material as to allow the use of thin-film technique for forming the insulation layer 90 or the use of etching process for its shaping is preferable for the material of the insulation layer 90. Examples of those materials are silicon dioxide, silicon nitride, organic materials, preferably those of low rigidity and high electrical insulation, e.g., photosensitive polyimide.

The contact holes 90*a* are formed at positions on the top of the insulation layer 90 where the insulation layer 90 covers the tops of the piezoelectric active portions 320. Through the contact holes 90*a*, the upper electrode films 80 are partly exposed and are to be connected to lead electrodes 100 to be described later. Each lead electrode 100 is connected at one end to the corresponding upper electrode film 80 and at the other end to the corresponding connection terminal. The width of each lead electrode 100 is as narrow as possible to such an extent as to sufficiently supply a drive signal to the related upper electrode film 80.

Figure 7B:
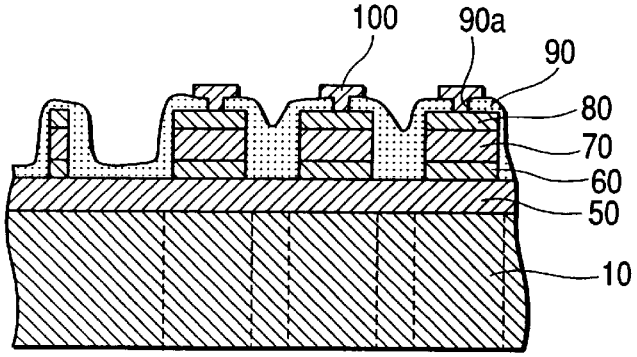
Figure 7C:
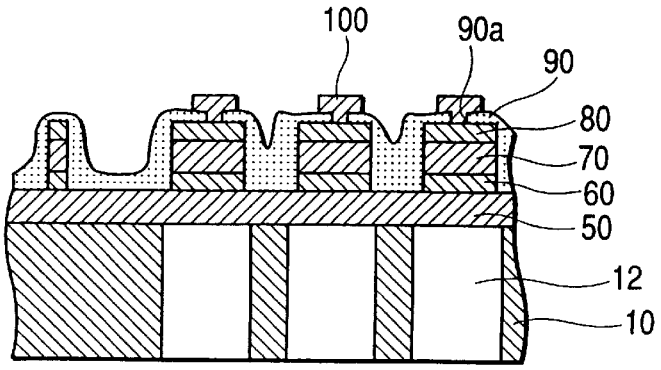
Figure 8A:
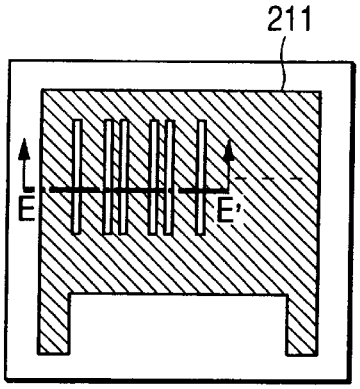
FIGS. 8(*a*)–(*e*) are diagrams showing a thin film producing process in the embodiment 2.
Figure 8B:
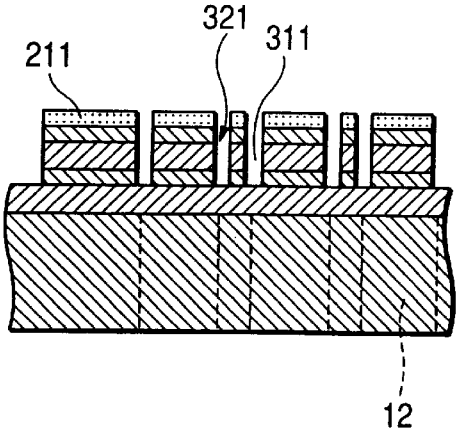
Figure 8C:
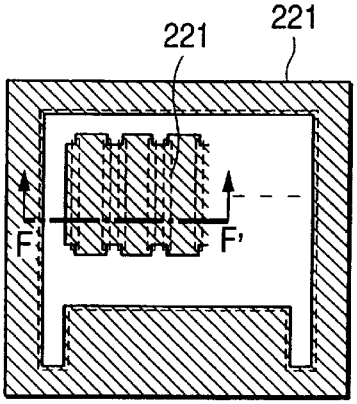
Figure 8D:
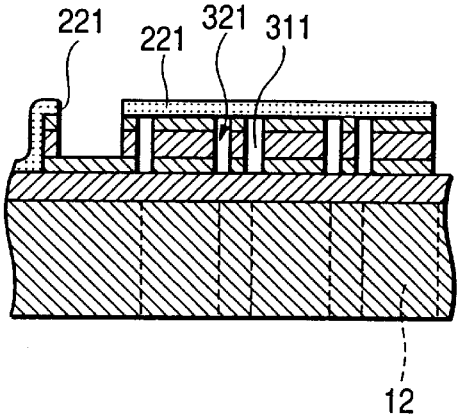
Figure 8E:
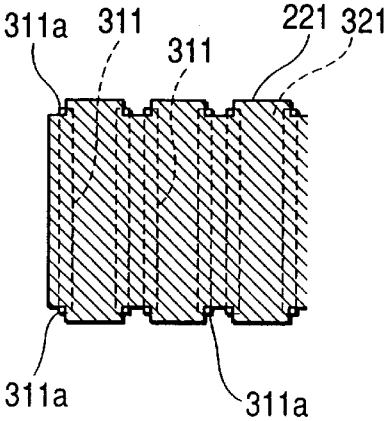

A process of forming such an insulation layer 90 is diagrammatically shown in FIG. 7.

An insulation layer 90 is formed covering the peripheral edge of the upper electrode film 80 and the side faces of the piezoelectric film 70, as shown in FIG. 7(*a*). The materials suitable for the insulation layer 90 are as described above. A negative photosensitive polyimide is used in this embodiment.

By patterning the insulation layer 90, as shown in FIG. 7(*b*), contact hole 90*a* are formed at positions-on the insulation layer 90, which substantially correspond to the ink supply ends of the pressure generating chambers 12. The contact holes 90*a* are provided for the connection of the lead electrodes 100 to the upper electrode films 80 of the piezoelectric active portions 320. The contact holes 90*a* may be formed at positions on the insulation layer 90 which substantially correspond to other portions of the pressure generating chambers 12, e.g., the central portions or the nozzle-side ends thereof.

To form the lead electrodes 100, the surface of the structure is entirely coated with a conductive material, e.g., Ci—Au, and the resultant conductive layer is patterned.

The thin-film forming process of the first embodiment is carried out as described above. Following the thin-film forming process, as shown in FIG. 7(*c*), the silicon monocrystalline substrate is anisotropically etched by use of the alkaline solution, to thereby form the pressure generating chamber 12 and the like. A number of chips are simultaneously formed on a single wafer by the process of sequential film forming steps and anisotropic etching. After the process of manufacture of ink jet print heads is completed, the wafer is sliced into a number of passage forming substrates 10 each having a chip size as shown in FIG. 1. Then, the sealing plate 20, common-ink-chamber forming substrate 30, and ink-chamber side plate 40 are successively layered on and bonded to each passage forming substrate 10 into a unit body of an ink jet print head.

To operate the thus constructed ink jet print head, ink is introduced from an external ink source (not shown) into the head, through the ink inlet 42. The inside of the print head ranging from the common ink chamber 31 to the nozzle openings 11 is filled with ink. Voltages dependent on print signals output from an external drive circuit (not shown) are, respectively, applied to between the pairs of the upper and lower electrodes 60 and 80 through the lead electrodes 100 to flexurally deform the elastic film 50, lower electrode film 60 and piezoelectric film 70. In turn, a pressure within each pressure generating chamber 12 is increased, so that the ink is ejected in the form of an ink droplet through the nozzle openings 11.

<Embodiment 2>

Also in the embodiment 2, the piezoelectric film 70 and the upper electrode film 80 are patterned for each pressure generating chamber 12, and the lower electrode film 60 located at the arm portions of the piezoelectric vibrator, or both sides thereof in its widthwise direction, are removed to increase a quantity of displacement of the piezoelectric vibrator. In the embodiment 2, those may be formed through a unique patterning of two steps. With this, narrow arm portions are formed at both ends (when longitudinally viewed) of the piezoelectric film 70 and the upper electrode film 80, which face their associated pressure generating chamber 12. Those narrow portions extend outward to beyond the region facing the pressure generating chamber 12. At both ends, the portion of the lower electrode film 60 corresponding to each pressure generating chamber 12 is connected to its whole pattern.

A process of the manufacture of ink jet print heads, which constitutes an embodiment 2 of the present invention, will be described with reference to FIG. 8. In the embodiment 2, the lower electrode film 60, piezoelectric film 70 and upper electrode film 80 are formed in the same manner as already described in the embodiment 1. No further description about the process of manufacturing those films will be given here.

Following the successive formation of the lower electrode film 60, piezoelectric film 70 and upper electrode film 80, those layered films are patterned. Specifically, a resist pattern 211 as shown in FIG. 8(*a*) is formed, and the layered structure of the lower electrode film 60, piezoelectric film 70 and upper electrode film 80 is selectively etched away by use of the resist pattern 211 as a mask, to thereby pattern a whole pattern of the lower electrode film 60 and lower-electrode removal portions 311.

The resist pattern 211 may be formed in a manner that the structure is coated with negative resist HR-100 (manufactured by Fuji Hant) by, for example, spin coating and the resultant is subjected to exposure, development, baking by use of a mask of a predetermined pattern. Positive resist may be used in place of the negative resist, as a matter of course.

The etching operation is continued till the elastic film 50 is exposed. A dry etching apparatus, e.g., an ion milling apparatus, may be used for the etching operation. The resist pattern 211 is removed by use of an ashing apparatus, for example.

Reaction etching process may be used in place of the ion milling process for the dry etching process. Wet etching process may be used in place of the dry etching process. However, the use of the dry etching process is suggestible because the wet etching process is inferior, in patterning accuracy, to the dry etching process, and in the wet etching process, the materials available for the upper electrode film 80 are limited in number.

The lower-electrode removal portion 311 corresponds to the arms of the vibration plates on both sides of each of the piezoelectric active portions 321, which are provided in the regions facing the pressure generating chambers 12 (those chambers are not yet formed in the manufacturing process stage of FIG. 8). It is noted that with removal of those portion of the lower electrode film 60, when voltage is applied across the piezoelectric active portion 321, a quantity of its flexural displacement is increased.

Only the layered structure consisting of the piezoelectric film 70 and the upper electrode film 80 is selectively etched away by use of a resist pattern 221 as an etching mask, which covers regions where the elastic film 50 is exposed, the regions facing the pressure generating chambers 12, and the regions of the lower-electrode removal portions 311, those regions being contained in the other portion than the whole pattern of the lower electrode film (FIG. 8(*c*)), whereby piezoelectric active portions 321 are patterned (FIG. 8(*d*)). Through the patterning operation, the films 70 and 80 are isolated from the films in other regions than those facing the pressure generating chambers 12. The formation of the resist pattern 221 and the etching operation may be performed in the same manner as previously described.

A major portion of the resist pattern 211 used in this process step is shown in FIG. 8(*e*) in an enlarged manner. The resist pattern 211 substantially covers the lower-electrode removal portions 311 and the piezoelectric active portions 321 each being located between the adjacent lower-electrode removal portions 311, except the corners 311*a* of both ends (when longitudinally viewed) of each of the lower-electrode removal portions 311.

Figure 9:
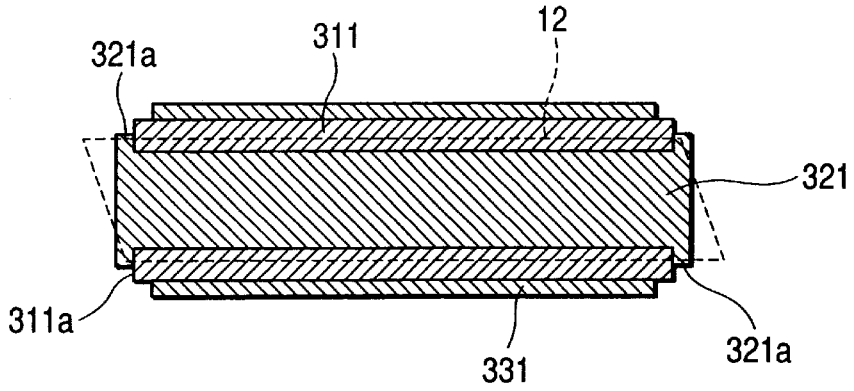
FIG. 9 is a plan view showing a key portion of the embodiment 2.

A configuration of one the thus constructed piezoelectric active portion 321 is typically illustrated in FIG. 9. As shown, both ends of each piezoelectric active portion 321 (when longitudinally viewed) are extended outward to have narrow arm portions 321*a*. The piezoelectric film 70 and the upper electrode film 80, which form the narrow arm portions 321*a*, are extended longitudinally outward beyond the corresponding pressure generating chamber 12, but the piezoelectric film 70 and the upper electrode film 80, which form the piezoelectric active portion 321, are not extended beyond the pressure generating chamber 12. The lower electrode film 60 is extended outward beyond the pressure generating chamber 12 to be continuous to the whole pattern thereof, at both ends of the pressure generating chamber 12 located between the narrow arm portions 321*a*. With this, wiring may be formed which is necessary for applying voltage to drive the piezoelectric active portion 321 corresponding to the related pressure generating chamber 12.

Since the narrow arm portions 321*a* of the piezoelectric active portion 321 are extended outward beyond the pressure generating chamber 12, crack little occurs in the narrow arm portions 321*a*. If occurring, there is little chance that it affects the main body of the piezoelectric active portion 321.

In patterning the piezoelectric active portions 321, the elastic film 50 is exposed in the lower-electrode removal portions 311. Therefore, it must be protected from the etching liquid. Since the resist pattern 221 is extended to the outside (when laterally viewed) of the lower-electrode removal portions 311, narrow strip portions 331 each consisting of the piezoelectric film 70 and the upper electrode film 80 are left on both sides (when laterally viewed) of each of lower-electrode removal portions 311. The piezoelectric active portions 321 are separated from the narrow strip portions 331 by the corners 311*a* of the lower-electrode removal portions 311, whereby an operation efficiency of the piezoelectric active portion 321 is prevented from being reduced.

Figure 10A:
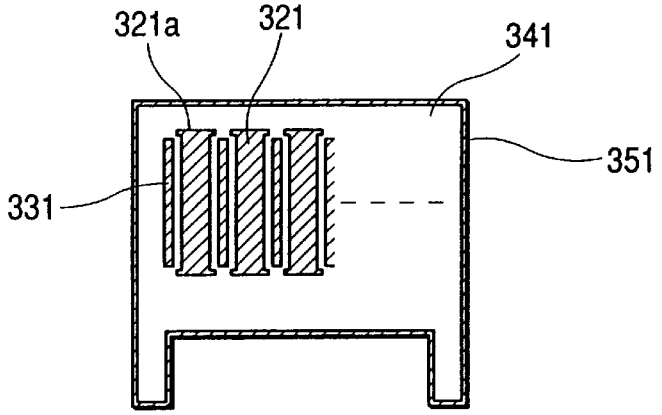
FIGS. 10*a* and 10*b* are plan views showing a key portion of the embodiment 2.

The piezoelectric film 70 and the upper electrode film 80, except those forming the piezoelectric active portions, are substantially removed in the embodiment under discussion. However, in the instant embodiment, the elastic film 50 is exposed in the other portions than the whole pattern of the lower electrode film 60. For protecting those portions against the etching liquid, the resist pattern 221 (FIG. 8(*c*)) is extended to cover the peripheral edge of the whole pattern of the lower electrode film 60. For this reason, a narrow fringe portion 351 consisting of the piezoelectric film 70 and the upper electrode film 80 is present around the whole lower-electrode pattern 341, as shown in FIG. 10*a*. The upper electrode films 80 layered on the narrow fringe portions 351 may be removed.

Figure 10B:
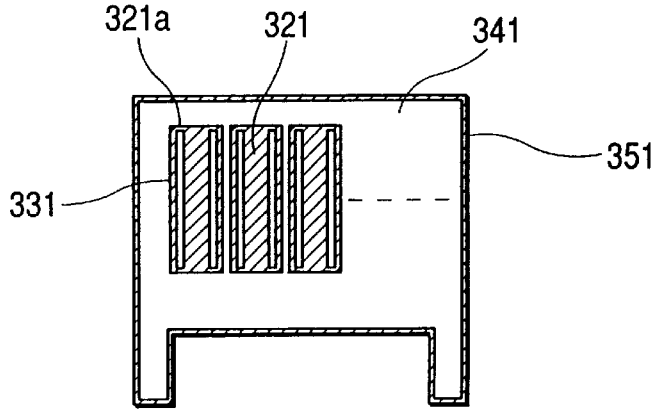

The narrow strip portions 331 may be continuous to the piezoelectric active portion 321 of the piezoelectric active portion 321. The piezoelectric active portion 321 and the narrow strip portion 331 may surround the lower-electrode removal portion 331, as shown in FIG. 10*b*. The upper electrode films 80 on the narrow strip portions 331 may be removed for securing a satisfactory operation efficiency of the piezoelectric active portion 321.

As described above, in the second embodiment, the whole pattern of the lower electrode film 60 and the lower-electrode removal portions 311 are patterned simultaneously. Thereafter, the structure is patterned by use of the resist pattern covering the lower-electrode removal portions 311 and the pressure generating chambers 12. Thus, only two patterning steps are required in this embodiment.

Following the patterning process, an insulation layer 90 having an electrical insulating nature is preferably formed covering at least the peripheral fringe of the top of the upper electrode film 80 and the side faces of the piezoelectric film 70. Such a preferable material as to allow the use of thin-film technique for forming the insulation layer 90 or the use of etching process for its shaping is preferable for the material of the insulation layer 90. Examples of those materials are silicon dioxide, silicon nitride, organic materials, preferably those of low rigidity and high electrical insulation, e.g., photosensitive polyimide.

The contact holes 90*a* are formed at positions on the top of the insulation layer 90 where the insulation layer 90 covers the tops of the piezoelectric active portions 321. Through the contact holes 90*a*, the upper electrode films 80 are partly exposed and are to be connected to lead electrodes 100 to be described later. Each lead electrode 100 is connected at one end to the corresponding upper electrode film 80 and at the other end to the corresponding connection terminal. The width of each lead electrode 100 is as narrow as possible to such an extent as to sufficiently supply a drive signal to the related upper electrode film 80.

Figure 11A:
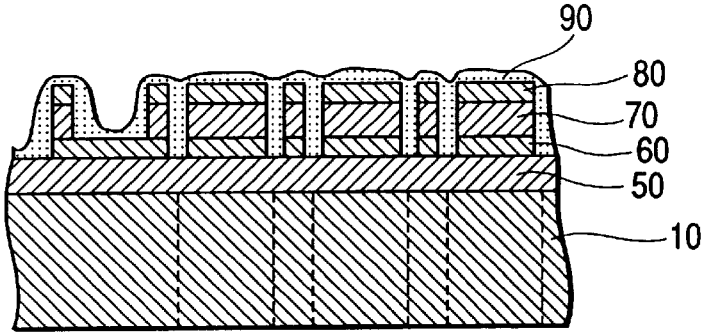
FIGS. 11(*a*)–(*c*) are diagrams showing a process of forming an insulation layer and a pressure generating chamber in the embodiment 2.
Figure 11B:
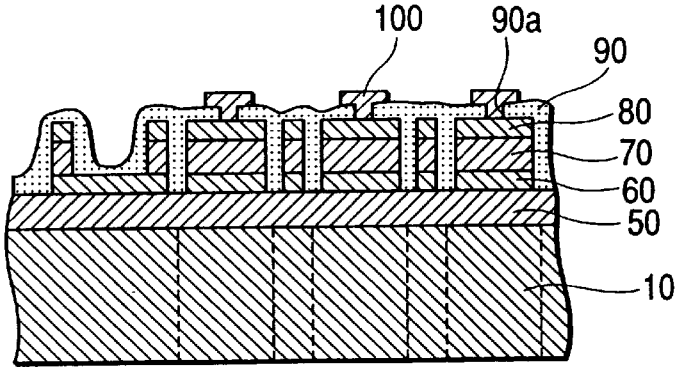
Figure 11C:
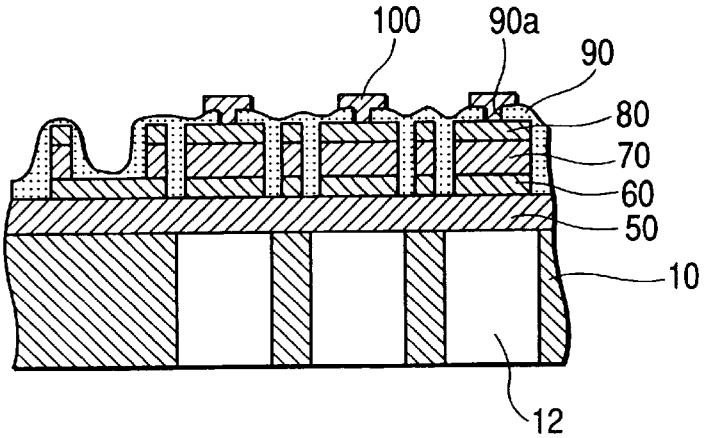

A process of forming such an insulation layer 90 is diagrammatically shown in FIG. 11.

An insulation layer 90 is formed covering the peripheral edge of the upper electrode film 80, the side faces of the piezoelectric film 70, and the side faces of the lower electrode film 60, as shown in FIG. 11(*a*). The materials suitable for the insulation layer 90 are as described above. A negative photosensitive polyimide is used in this embodiment.

By patterning the insulation layer 90, as shown in FIG. 11(*b*), contact hole 90*a* are formed at positions on the insulation layer 90, which substantially correspond to the ink supply ends of the pressure generating chambers 12. The contact holes 90*a* are provided for the connection of the lead electrodes 100 to the upper electrode films 80 of the piezoelectric active portions 320. The contact holes 90*a* may be formed at positions on the insulation layer 90 which substantially correspond to other portions of the pressure generating chambers 12, e.g., the central portions or the nozzle-side ends thereof.

To form the lead electrodes 100, the surface of the structure is entirely coated with a conductive material, e.g., Ci—Au, and the resultant conductive layer is patterned.

The thin-film forming process of the first embodiment is carried out as described above. Following the thin-film forming process, as shown in FIG. 11(*c*), the silicon monocrystalline substrate is anisotropically etched by use of the alkaline solution, to thereby form the pressure generating chamber 12 and the like. A number of chips are simultaneously formed on a single wafer by the process of sequential film forming steps and anisotropic etching. After the process of manufacture of ink jet print heads is completed, the wafer is sliced into a number of passage forming substrates 10 each having a chip size as shown in FIG. 1. Then, the sealing plate 20, common-ink-chamber forming substrate 30, and ink-chamber side plate 40 are successively layered on and bonded to each passage forming substrate 10 into a unit body of an ink jet print head.

To operate the thus constructed ink jet print head, ink is introduced from an external ink source (not shown) into the head, through the ink inlet 42. The inside of the print head ranging from the common ink chamber 31 to the nozzle openings 11 is filled with ink. Voltages dependent on print signals output from an external drive circuit (not shown) are, respectively, applied to between the pairs of the upper and lower electrodes 60 and 80 through the lead electrodes 100 to flexurally deform the elastic film 50, lower electrode film 60 and piezoelectric film 70. In turn, a pressure within each pressure generating chamber 12 is increased, so that the ink is ejected in the form of an ink droplet through the nozzle openings 11.

<Embodiment 3>

Figure 12:
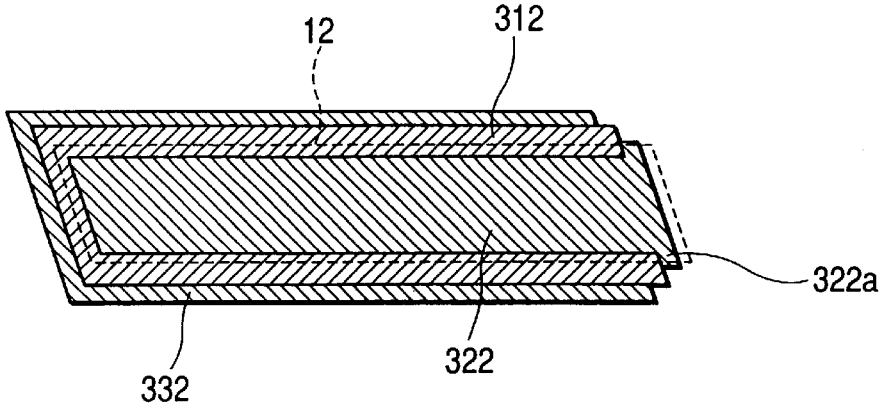
FIG. 12 is a plan view showing a key portion of the embodiment 3.

FIG. 12 is a diagram showing typically the structure including a piezoelectric active portion and a pressure generating chamber, which is to be used in an ink jet print head constituting an embodiment 3 of the present invention.

The embodiment 3 is different from the embodiment 2 in that narrow arm portions 322*a* are formed at only one end of a piezoelectric active portion 322 (when longitudinally viewed), and that a lower-electrode removal portion 312, shaped like U, is formed surrounding the piezoelectric active portion 322 except the portion between the narrow arm portions 322*a* of the piezoelectric active portion 322. The lower electrode film 60 in the region facing the pressure generating chamber 12 is continuous to its whole pattern only between the narrow arm portions 322*a* of the piezoelectric active portion 322. A narrow strip portion 332, shaped like U, is formed surrounding the lower-electrode removal portion 312 while being separated from the piezoelectric active portion 322.

The ink jet print head of the embodiment 3 may be manufactured in the substantially same manner as of the embodiment 2 and the operation and effects of the embodiment 3 are substantially the same as of the embodiment 2.

<Embodiment 4>

Figure 13:
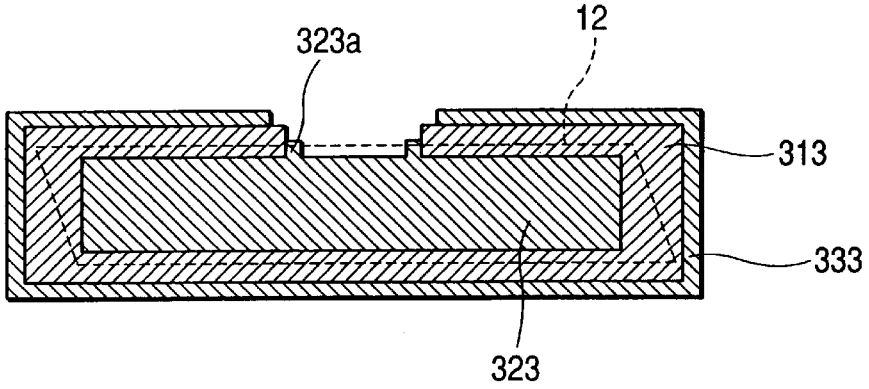
FIG. 13 is a plan view showing a key portion of the embodiment 4.

FIG. 13 is a diagram showing typically the structure including a piezoelectric active portion and a pressure generating chamber, which is to be used in an ink jet print head constituting an embodiment 4 of the present invention.

The embodiment 3 is different from the embodiment 2 in that narrow arm portions 323*a* of a piezoelectric active portion 323 are formed on only one side of the pressure generating chamber 12 when viewed in its widthwise direction. A lower-electrode removal portion 313 is formed surrounding the pressure generating chamber 12 except the portion between the narrow arm portions 323*a*. Also in this embodiment, the lower electrode film 60 in the region facing the pressure generating chamber 12 is continuous to its whole wiring pattern only between the narrow arm portions 323*a* of the piezoelectric active portion 323. A narrow strip portion 333, shaped like U, is formed surrounding the lower-electrode removal portion 313 while being separated from the piezoelectric active portion 323.

The ink jet print head of the embodiment 4 may be manufactured in the substantially same manner as of the embodiment 2 and the operation and effects of the embodiment 4 are substantially the same as of the embodiment 2. In this embodiment, the narrow arm portions 323*a* of the piezoelectric active portion 323 are provided on the side surface of the pressure generating chamber 12 whose flexural deformation is relatively large. Since the width of each narrow arm portion 323*a* is relatively small, stress little cracks there. If it cracks, there is no chance that it affects the main body of the piezoelectric active portion 323.

<Embodiment 5>

Figure 14:
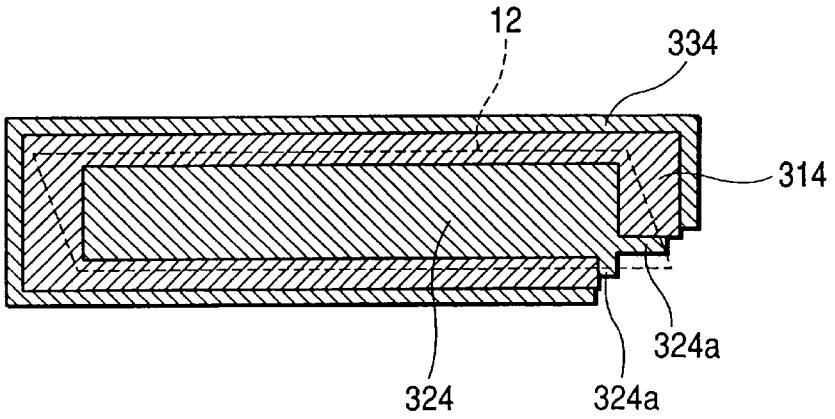
FIG. 14 is a plan view showing a key portion of the embodiment 5.

FIG. 14 is a diagram showing typically the structure including a piezoelectric active portion and a pressure generating chamber, which is to be used in an ink jet print head constituting an embodiment 5 of the present invention.

The embodiment 5 is different from the embodiment 3 in that narrow arm portions 324*a* of the piezoelectric active portion 324 are provided at one corner of the pressure generating chamber 12. A lower-electrode removal portion 314 is formed surrounding the piezoelectric active portion 324 except the portion thereof between the narrow arm portions 324*a*. Also in this embodiment, the lower electrode film 60 in the region facing the pressure generating chamber 12 is continuous to its whole pattern only between the narrow arm portions 324*a* of the piezoelectric active portion 324. A narrow strip portion 334, shaped like U, is formed surrounding the lower-electrode removal portion 314 while being separated from the piezoelectric active portion 324.

The ink jet print head of the embodiment 5 may be manufactured in the substantially same manner as of the embodiment 2 and the operation and effects of the embodiment 4 are substantially the same as of the embodiment 2. In this embodiment, the narrow arm portions 324*a* of the piezoelectric active portion 324 are provided on the side surface of the pressure generating chamber 12 whose flexural deformation is the smallest in quantity. Therefore, stress acting on the narrow arm portions 324*a* are reduced and hence the probability of occurrence of cracking is reduced.

<Additional embodiment and modifications>

While the present invention has been described using some specific embodiments, it is to be understood that the present invention is not limited to the above-described ones.

The common-ink-chamber forming substrate 30 as well as the sealing plate 20 may be made of glass ceramics. Further, the thin wall 41 may be formed separately from the ink-chamber side plate 40, and in this case, it may be made of glass ceramics. Its material and structure may be selected and designed as desired.

The nozzle openings are formed in the end face of the passage forming substrate 10 in the above-mentioned embodiments. If required, those nozzle openings may be formed at right angles to the surface of the passage forming substrate 10.

Figure 15:
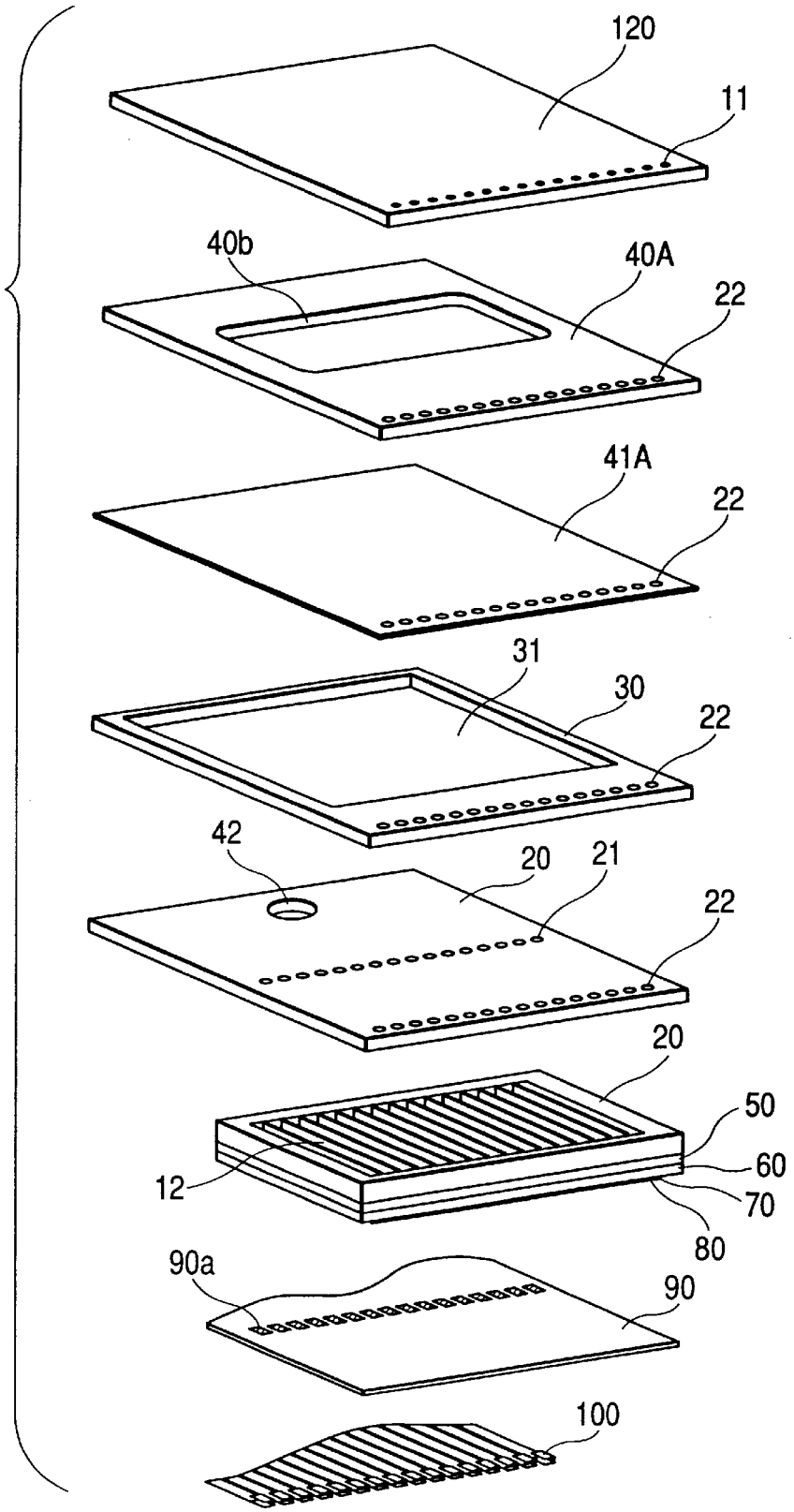
FIG. 15 is an exploded, perspective view showing an ink jet print head which is another embodiment of the present invention.
Figure 16:
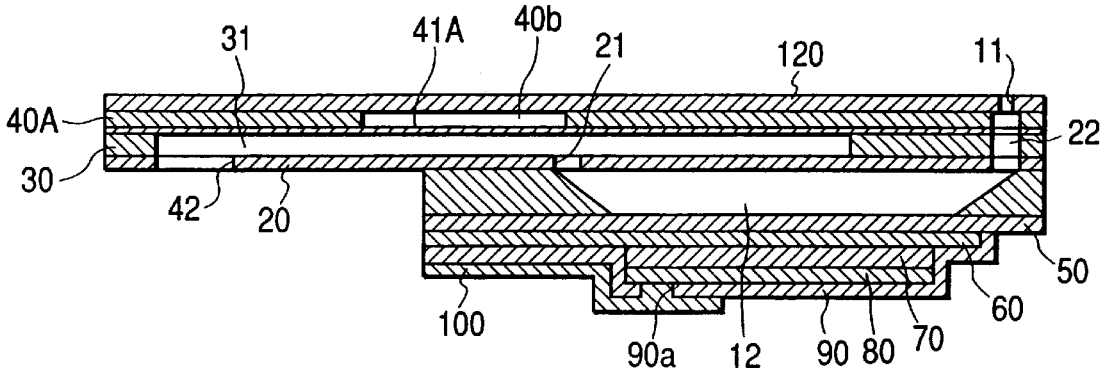
FIG. 16 is a cross sectional view showing an ink jet print head which is yet another embodiment of the present invention.

This technical idea may be implemented as shown in FIGS. 15 and 16. FIG. 15 shows an exploded view in perspective of the implementation or an ink jet print head forming an additional embodiment of the present invention, and FIG. 16 shows a sectional view of a major portion of the same. As shown, nozzle openings 11 are formed in a nozzle substrate 120 located on the opposite side of the piezoelectric vibrator. Nozzle ink passages 120 for communicatively connecting those nozzle openings 11 to pressure generating chambers 12 are formed passing through a sealing plate 20, common-ink-chamber forming substrate 30, thin plates 41A and ink-chamber side plates 40A.

The basic construction of the additional embodiment is substantially the same as that of each of the above-mentioned embodiments except that the thin plate 41A is separate from the ink-chamber side plate 40A, and openings 40*b* are formed in the ink-chamber side plates 40. Hence, like reference numerals are used for designating like or equivalent portions in the above-mentioned embodiments.

The thin-film ink jet print head manufactured by the utilization of thin-film technique and lithography technique was discussed in the above-mentioned embodiments. For forming the piezoelectric film, any other suitable method, for example, the sticking of a green sheet, the screen printing, the crystal growth or the like, may be used instead of the above ones, as a matter of course.

In the embodiments mentioned above, the insulation layer is interlayered between the piezoelectric vibrator and the lead electrode. If required, the insulation layer may be omitted. In this case, anisotropic conductive films, which are thermally bonded onto the respective upper electrode films, are connected to the lead electrodes. Thermal bonding or any other suitable bonding technique may be used for their connections.

Thus, the present invention is applicable for ink jet print heads having various structures within the spirits of the invention.

Figure 17:
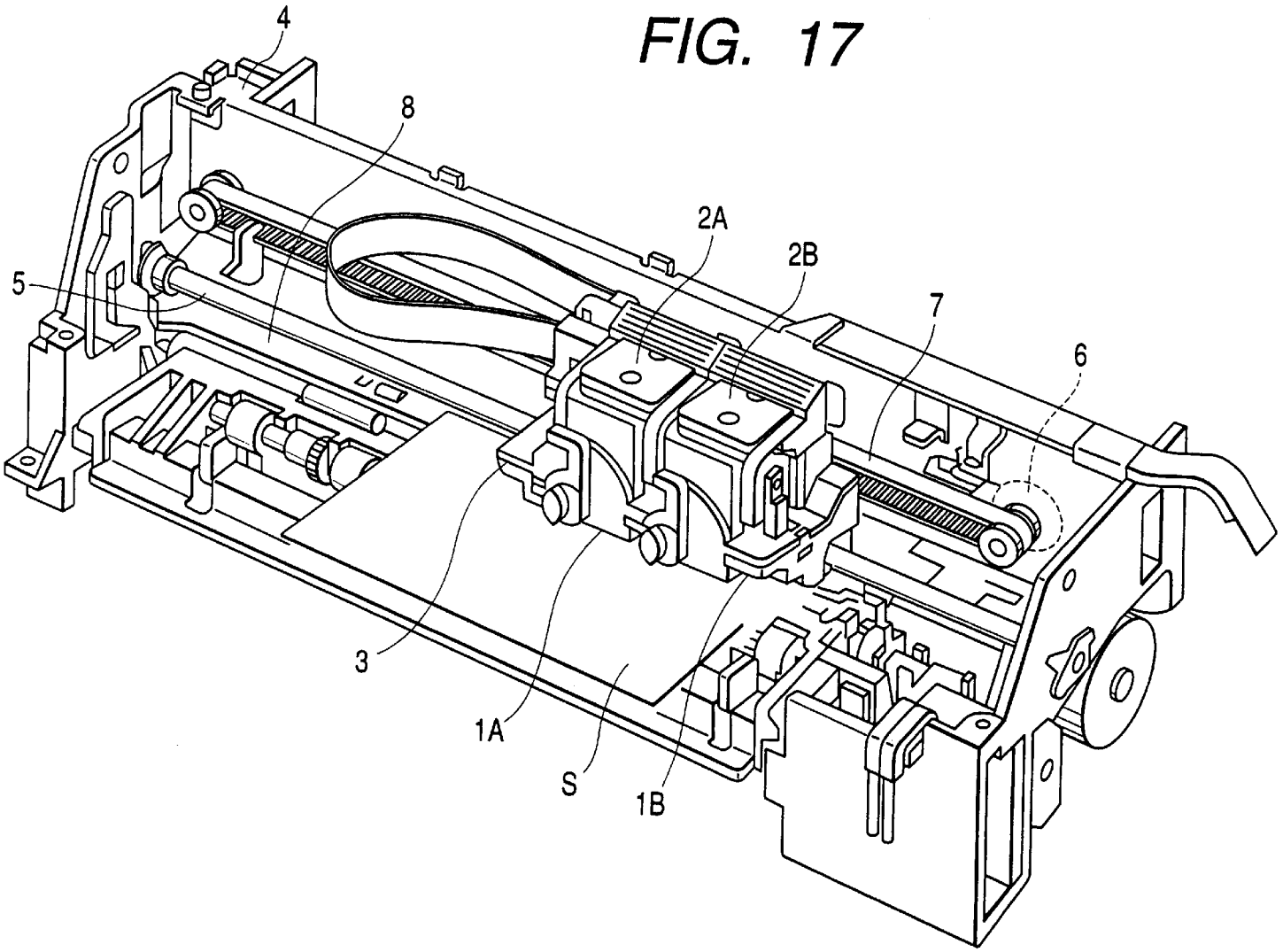
FIG. 17 is a perspective view showing one example of the ink jet printing apparatus thus provided.

The ink jet print head according to the various embodiments of the invention as described above constitutes a part of a print head unit which is provided with an ink flow passage communicating with ink cartridge or the like, and the print head unit is mounted onto ink jet printing apparatus. FIG. 17 is a perspective view showing one example of the ink jet printing apparatus thus provided.

As shown in FIG. 17, ink cartridges 2A and 2B each performing as an ink supply source means are detachably mounted on print head units 1A and 1B each having the ink jet print head, respectively. The print head unit 1A and 1B are installed on a carriage 3 which is mounted on a carriage shaft 5 to be slidable in the axial direction thereof. The print head unit 1A and 1B are provided for ejecting, for example, a black ink composition and color ink composition, respectively.

When a driving force of a drive motor 6 is transmitted to the carriage 3 through a plurality of gears not shown and a timing belt 7, the carriage 3 on which the print head units 1A and 1B are installed moves along the carriage shaft 5. On the other hand, a printer apparatus body 4 is also provided with a platen 8 arranged along the carriage shaft 5 for feeding a print sheet S which is a printing medium such as paper fed by a paper feeding roller not shown, for example.

As seen from the foregoing description, the piezoelectric vibrator is constructed so as to act on only the region facing the pressure generating chamber. The lower electrode film that exists in a portion extended out of a region facing the pressure generating chamber within the region facing the pressure generating chamber is minimized. Therefore, a large quantity of displacement of the piezoelectric vibrator is secured, and there is no chance of destroying the piezoelectric film and the like. In another aspect of the invention, a portion extended out of the region facing the pressure generating chamber takes the form of a pair of narrow arm portions. The lower electrode film that exists in a portion extended out of a region facing the pressure generating chamber within the region facing the pressure generating chamber is minimized. Further, the lower electrode films in the region facing the pressure generating chamber are continuous to the lower electrode films of the whole wiring pattern between each pair of narrow arm portions. This brings about the following beneficial effects: the maximizing of the displacement, no crack of the piezoelectric films and the like, and no increase of the number of patterning steps.

What is claimed is:

1. An ink jet print head comprising a plurality of pressure generating chambers, an elastic film, and piezoelectric elements corresponding to said pressure generating chambers, the piezoelectric elements being formed in respective regions facing said pressure generating chambers, and each of said piezoelectric elements including a lower electrode film, a piezoelectric film and an upper electrode film, wherein, for each pressure generating chamber, A) said piezoelectric film and said upper electrode film are formed within said respective region facing said corresponding pressure generating chamber; and B) a portion of said lower electrode film facing said corresponding pressure generating chamber is continuous to outside said respective region facing said corresponding pressure generating chamber to a wiring pattern interconnecting said regions facing said corresponding pressure generating chambers; and wherein, within each of said regions facing said pressure generating chambers, a portion of said lower electrode film facing a peripheral edge of said piezoelectric film is removed.

2. The ink jet print head according to claim 1, wherein in each of said regions facing said pressure generating chambers, said removed portion of said lower electrode film facing the peripheral edge of said piezoelectric film is along a longitudinal side of said corresponding pressure generating chamber.

3. The ink jet print head according to any of claims 1 or 2, wherein said pressure generating chambers are formed in a silicon monocrystalline substrate by anisotropic etching, and said respective layers of said piezoelectric elements are formed by thin-film technique and lithography technique.

4. The ink jet print head according to claim 1, wherein an insulating layer is formed on the top surface of said upper electrode films, and said insulating layer has contact holes as a window for forming contact portions of lead electrodes and said upper electrode films.

5. The ink jet print head according to claim 1, wherein said lower electrode film is also formed within a passive region which separates each of said pressure generating chambers.

6. An ink jet print head comprising a plurality of pressure generating chambers, an elastic film, and piezoelectric elements corresponding to said pressure generating chambers, the piezoelectric elements being formed in respective regions facing said pressure generating chambers, and each of said piezoelectric elements including a lower electrode film, a piezoelectric film and an upper electrode film, wherein, for each pressure generating chamber, A) said piezoelectric film, said upper electrode film, and said lower electrode film are formed within said respective region facing said corresponding pressure generating chamber, while a pair of narrow arm portions of said piezoelectric film and said upper electrode film extend outward beyond said respective region facing said corresponding pressure generating chamber; and B) a portion of said lower electrode film in said respective region facing said corresponding pressure generating chamber is continuous to outside said respective region facing said corresponding pressure generating chamber to a wiring pattern interconnecting said regions facing said pressure generating chambers.

7. The ink jet print head according to claim 6, wherein narrow strip layers comprising at least said piezoelectric film and said lower electrode film are formed, respectively, between adjacent active portions of said piezoelectric layer and said upper electrode layer facing corresponding adjacent pressure chambers of said passage forming substrate.

8. The ink jet print head according to claim 7, further comprising an additional narrow strip portion including said piezoelectric film and said upper electrode film formed on said lower electrode film along a peripheral edge of said lower electrode film.

9. The ink jet print head according to claim 7, wherein said narrow strip layers are narrower than said piezoelectric film and said upper electrode film formed within said respective region facing each of said corresponding pressure generating chambers, and wherein said narrow strip layers are not continuous to said narrow arm portions.

10. The ink jet print head according to claim 6, wherein each of said pairs of narrow arm portions of said piezoelectric layers and said upper electrode layers extend from at least one end, when longitudinally viewed, of each of said piezoelectric elements at both sides thereof in a widthwise direction orthogonal to a lengthwise direction thereof and to beyond said respective region facing said pressure generating chamber.

11. The ink jet print head according to claim 6, wherein each of said pairs of narrow arm portions, each comprising said piezoelectric layer and said upper electrode layer, is located on one side of each of said piezoelectric elements when viewed in a widthwise direction orthogonal to a lengthwise direction of said piezoelectric element, while extending outward from said respective region facing said pressure generating chamber.

12. The ink jet print head according to claim 6, wherein each of said pairs of narrow arm portions of said piezoelectric layers and said upper electrode layers is located on both sides of a corner of each said piezoelectric elements, while extending in directions orthogonal to each other to beyond said respective region facing said pressure generating chamber.

13. The ink jet print head according to any of claims 6, 7, 10, 11 or 12, wherein said pressure generating chambers are formed in a silicon monocrystalline substrate by anisotropic etching, and said respective layers of said piezoelectric elements are formed by thin-film technique and lithography technique.

14. The ink jet print head according to claim 6, wherein an insulating layer is formed on the top surface of said upper electrode films, and said insulating layer has contact holes as a window for forming contact portions of lead electrodes and said upper electrode films.

15. The ink jet print head according to claim 6, wherein said pair of narrow arm portions which are extended outward are narrower than a remainder of said piezoelectric film and said upper electrode film formed within said respective region facing said corresponding pressure generating chamber.

16. The ink jet print head according to claim 6, wherein within each of said regions facing said pressure generating chambers, a portion of said lower electrode film not facing said piezoelectric film is removed except a part thereof located between said pair of narrow arm portions.

17. The ink jet print head according to claim 6, wherein said lower electrode film in each of said regions facing said pressure generating chambers is continuous to said wiring pattern between said respective pair of narrow arm portions.

18. An ink jet print head comprising a plurality of pressure generating chambers, an elastic film, and piezoelectric elements corresponding to said pressure generating chambers, the piezoelectric elements being formed in respective regions facing said pressure generating chambers, and each of said piezoelectric elements including a lower electrode film, a piezoelectric film and an upper electrode film, wherein, for each pressure generating chamber, A) said piezoelectric film and said upper electrode film are formed within said respective region facing said corresponding pressure generating chamber, while a pair of narrow arm portions of said piezoelectric film and said upper electrode film extend outward beyond said respective region facing said corresponding pressure generating chamber, said pair of narrow arm portions which are extended outward are narrower than a remainder of said piezoelectric film and said upper electrode film formed within said respective region facing said corresponding pressure generating chambers;

B) portions of said lower electrode film in said respective region facing said corresponding pressure generating chamber is continuous outside said respective region facing corresponding said pressure generating chamber to a wiring pattern interconnecting said regions facing said pressure generating chambers and, within each of said regions facing said pressure generating chambers, a portion of said lower electrode film not facing said piezoelectric film is removed except a part thereof located between said pair of narrow arm portions, and wherein said lower electrode film in each of said regions facing said pressure generating chambers is continuous to said wiring pattern between said respective pair of narrow arm portions; and C) a narrow strip layer comprising at least said piezoelectric layer and said lower electrode film is formed along an outer edge of said wiring pattern of said lower electrode film.

19. The ink jet print head according to claim 18, wherein each of said pairs of narrow arm portions of said piezoelectric layers and said upper electrode layers extend from at least one end, when longitudinally viewed, of each said piezoelectric elements at both sides thereof in a widthwise direction orthogonal to a lengthwise direction thereof and to beyond said respective region facing said pressure generating chamber.

20. The ink jet print head according to claim 18, wherein each of said pairs of narrow arm portions, each comprising said piezoelectric layer and said upper electrode layer is located on one side of each said piezoelectric elements when viewed in a widthwise direction orthogonal to a lengthwise direction of said piezoelectric element, while extending outward from said respective region facing said pressure generating chamber.

21. The ink jet print head according to claim 18, wherein each of said pairs of narrow arm portions of said piezoelectric layers and said upper electrode layers is located on both sides of a corner of each said piezoelectric element, while extending in directions orthogonal to each other to beyond said respective region facing said pressure generating chamber.

22. The ink jet print head according to any of claims 18, 19, 20 or 21, wherein said pressure generating chambers are formed in a silicon monocrystalline substrate by anisotropic etching, and said respective layers of said piezoelectric elements are formed by thin film technique and lithography technique.

23. The ink jet print head according to claim 18, wherein an insulating layer is formed on the top surface of said upper electrode films, and said insulating layer has contact holes as a window for forming contact portions of lead electrodes and said upper electrode films.

24. An ink jet printing apparatus installing thereon the ink jet print head according to any one of claims 6 or 18.

25. A process for producing an ink jet print head comprising:

a first step of successively forming a silicon dioxide film, a lower electrode film, a piezoelectric film and an upper electrode film, in this order, on a silicon substrate;

a second step of simultaneously patterning said lower electrode film, said piezoelectric film and said upper electrode film, to thereby form a whole wiring pattern of said lower electrode film;

a third step of patterning said piezoelectric film and said upper electrode film to form piezoelectric elements within respective regions facing corresponding pressure generating chambers formed in the substrate; and a fourth step of patterning said lower electrode film to remove portions, defined as third portions of said lower electrode film except portions, defined as second portions thereof, which are continuous to the wiring pattern located out of said regions facing said corresponding pressure generating chambers, said second portions belonging to portions, defined as first portions not having said piezoelectric films forming said piezoelectric elements formed thereon in said regions facing said pressure generating chambers.

26. The print head producing process according to claim 25, wherein said lower electrode film removed in said-fourth step is located on both sides of each of said corresponding pressure generating chambers.

27. A process for producing an ink jet print head comprising:

a first step in which a first layer is formed on a substrate and then a second layer, a third layer, and one or more subsequent layers are formed on said substrate in a successive manner;

a second step in which said plural number of layers formed on said first layer are simultaneously patterned to form the whole pattern of said second layer on said first layer and removal portions where said second and subsequent layers are removed within said whole pattern of said second layer; and a third step in which by use of a resist pattern covering said removal portions and portions surrounded by said removal portions, said third layer and the subsequent one or more layers are removed so that only said second layer is continuous and said third layer and the subsequent one or more layers are not continuous to include non-continuous adjacent active portions which face corresponding adjacent pressure chambers of said substrate and non-continuous strip portions which are formed, respectively, between said adjacent active portions.

28. A process for producing an ink jet print head comprising:

a first step for successively forming an elastic film, a lower electrode layer, a piezoelectric layer and an upper electrode layer on a passage forming substrate;

a second step in which said lower electrode layer, said piezoelectric layer and said upper electrode layer are simultaneously patterned to form a whole pattern of said lower electrode layer and removal portions where said lower electrode layer and subsequent layers are removed within said whole pattern of said lower electrode layer; and a third step in which by use of a resist pattern covering said removal portions and portions surrounded by said removal portions, said piezoelectric layer and said upper electrode layer are removed so that only said lower electrode layer is continuous and said piezoelectric layer and said upper electrode layer are not continuous to include non-continuous adjacent active portions which face corresponding adjacent pressure chambers of said passage forming substrate and non-continuous strip portions which are formed, respectively, between said adjacent active portions.

29. The print head producing process according to claim 28, wherein said elastic film exposed at said removal portions is protected in said third step by the resist pattern which substantially covers said removal portions.

30. The print head producing process according to claim 28 or 29, wherein said removal portions substantially surround said active portions, and wherein the resist pattern forming the patterns of said active portions in said third step covers ends opposite to said active portions substantially surrounded by said removal portions, and does not cover a part of each of said removal portions for isolating said active portions.

31. The print head producing process according to either of claims 28 or 29, wherein said active portions substantially surrounded by said removal portions are regions facing said pressure generating chambers, said lower electrode layer, said piezoelectric layer and said upper electrode layer are patterned to have the layered structures of said layers each in each of said regions facing said pressure generating chambers, said piezoelectric layer and said upper electrode layer of each said layered structures are not extended so as not to be continuous between active portions, and only said lower electrode layer is continuous between active portions and to be connected to a wiring pattern of said print head.

32. The print head producing process according to claim 30, wherein said active portions substantially surrounded by said removal portions are regions facing said pressure generating chambers, said lower electrode layer, said piezoelectric layer and said upper electrode layer are patterned to have the layered structures of said layers each in each of said regions facing said pressure generating chambers, said piezoelectric layer and said upper electrode layer of each said layered structures are not extended so as not to be continuous between active portions, and only said lower electrode layer is continuous between active portions and to be connected to a wiring pattern of said print head.

33. The print head producing process according to claim 28, wherein said third step includes the formation of an additional narrow strip portion including said piezoelectric layer and said upper electrode layer formed on said lower electrode layer along a peripheral edge of said lower electrode layer.

34. An ink jet print head comprising a plurality of pressure generating chambers, an elastic film, and piezoelectric elements, the piezoelectric elements being formed in respective regions facing said pressure generating chambers, and each of said piezoelectric elements including a lower electrode film, a piezoelectric film and an upper electrode film, wherein A) said piezoelectric film and said upper electrode film are formed within said region facing each of said pressure generating chambers; and B) said lower electrode film extending continuously over the pressure generating chambers and having a slit formed in said lower electrode film.

35. The ink jet print head according to claim 34, wherein said slit is formed within one of said regions facing said corresponding pressure generating chambers.

36. The ink jet print head according to claim 34, wherein said slit is formed within one of said regions facing said corresponding pressure generating chambers so that said slit is aligned along a longitudinal direction of said corresponding pressure generating chamber.

37. An ink jet print head comprising a plurality of pressure generating chambers, an elastic film, and piezoelectric elements corresponding to said pressure generating chambers, the piezoelectric elements being formed in respective regions facing said pressure generating chambers, and each of said piezoelectric elements including a lower electrode film, a piezoelectric film and an upper electrode film, wherein, for each pressure generating chamber, A) said piezoelectric film, said upper electrode film, and said lower electrode film are formed within said respective region facing said corresponding pressure generating chamber, while a narrow arm portion of said piezoelectric film and said upper electrode film extends outward beyond said respective region facing said corresponding pressure generating chamber; and B) a portion of said lower electrode film in said respective region facing said corresponding pressure generating chamber is continuous to outside said respective region facing said corresponding pressure generating chamber to a wiring pattern interconnecting said regions facing said pressure generating chambers.

38. The ink jet print head according to claim 35, wherein said narrow arm portion which is extended outward is narrower than a remainder of said piezoelectric film and said upper electrode film formed within said respective region facing said corresponding pressure generating chamber.

39. The ink jet print head according to claim 37, wherein within each of said regions facing said pressure generating chambers, a portion of said lower electrode film not facing said piezoelectric film is removed except a part thereof adjacent said narrow arm portion.

40. The ink jet print head according to claim 37, wherein said lower electrode film in each of said regions facing said pressure generating chambers is continuous to said wiring pattern adjacent said narrow arm portion.

41. An ink jet printing apparatus installing thereon the ink jet print head according to claim 37.

* * * * *